US012766373B2

(12) United States Patent
Carr

(10) Patent No.: US 12,766,373 B2
(45) Date of Patent: Oct. 20, 2026

(54) GOLF CLUB HEAD WITH IMPROVED STRIKING FACE

(71) Applicant: Acushnet Company, Fairhaven, MA (US)

(72) Inventor: Kyle A. Carr, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 295 days.

(21) Appl. No.: 18/428,460

(22) Filed: Jan. 31, 2024

(65) Prior Publication Data

US 2024/0173599 A1 May 30, 2024

Related U.S. Application Data

(63) Continuation-in-part of application No. 18/346,026, filed on Jun. 30, 2023, which is a continuation-in-part of application No. 17/941,418, filed on Sep. 9, 2022, now Pat. No. 12,533,557, which is a continuation-in-part of application No. 17/471,040, filed on Sep. 9, 2021, now Pat. No. 12,582,880.

(51) Int. Cl.
*A63B 53/04* (2015.01)

(52) U.S. Cl.
CPC ..... *A63B 53/0462* (2020.08); *A63B 53/0416* (2020.08); *A63B 2053/0491* (2013.01)

(58) Field of Classification Search
CPC ..... A63B 53/0462; A63B 53/0416; A63B 53/0491
See application file for complete search history.

(56) References Cited

U.S. PATENT DOCUMENTS

| | | | | |
|---|---|---|---|---|
| 4,432,549 | A | 2/1984 | Zebelean | |
| 6,595,057 | B2 | 7/2003 | Bissonnette | |
| 6,679,786 | B2 | 1/2004 | McCabe | |
| 6,800,038 | B2 | 10/2004 | Willett | |
| 6,824,475 | B2 | 11/2004 | Burnett | |
| 6,863,626 | B2 | 3/2005 | Evans | |
| 7,066,832 | B2 | 6/2006 | Willett | |
| 7,285,060 | B2 | 10/2007 | Williams | |
| 8,801,541 | B2 | 8/2014 | Beach | |
| 8,911,304 | B1 * | 12/2014 | Dawson | A63B 60/02 473/291 |
| 9,517,392 | B2 * | 12/2016 | Ueda | A63B 60/02 |
| 9,675,849 | B2 | 6/2017 | Beach | |
| 10,004,955 | B2 | 6/2018 | Henrikson | |
| 10,238,938 | B2 | 3/2019 | Schweigert | |
| 10,258,843 | B2 | 4/2019 | Morales | |
| 10,500,449 | B2 | 12/2019 | Henrikson | |

(Continued)

FOREIGN PATENT DOCUMENTS

| | | |
|---|---|---|
| JP | 2002-239040 | 8/2002 |
| JP | 2020-518372 A | 6/2020 |

*Primary Examiner* — William M Pierce
(74) *Attorney, Agent, or Firm* — Mike S. Kim

(57) ABSTRACT

A golf club head with an improved striking face is disclosed. More specifically, the present invention relates to a golf club head. The golf club head includes a striking face portion that includes a frontal striking surface and a rear internal surface that combine to include a thickened central region, a central transition region, a thinned intermediate region, a thickened stress reducing region, and a thinned perimeter region. The thickened stress reducing region includes a pocket and a weight.

20 Claims, 27 Drawing Sheets

(56) References Cited

U.S. PATENT DOCUMENTS

| | | | | |
|---|---|---|---|---|
| 10,751,587 | B2 | 8/2020 | Clarke | |
| 10,758,789 | B2 | 9/2020 | Bacon | |
| 10,905,925 | B2 | 2/2021 | Morales | |
| 10,905,926 | B2 | 2/2021 | Morales | |
| 10,918,919 | B2 | 2/2021 | Morales | |
| 12,243,085 | B1 * | 3/2025 | Soracco | G05B 19/4099 |
| 2007/0225084 | A1 * | 9/2007 | Schweigert | A63B 53/04 473/324 |
| 2009/0305815 | A1 * | 12/2009 | Hirano | A63B 53/047 473/350 |
| 2012/0071270 | A1 * | 3/2012 | Nakano | A63B 53/04 473/349 |
| 2014/0323237 | A1 | 10/2014 | Beno et al. | |
| 2016/0184665 | A1 * | 6/2016 | Nakamura | A63B 53/047 473/335 |
| 2016/0243413 | A1 * | 8/2016 | Ritchie | A63B 53/047 |
| 2016/0296808 | A1 * | 10/2016 | Harrington | A63B 60/52 |
| 2016/0354650 | A1 * | 12/2016 | Norimura | A63B 53/047 |
| 2019/0192927 | A1 | 6/2019 | Bacon et al. | |
| 2020/0346081 | A1 | 11/2020 | Bacon | |

* cited by examiner

GOLF CLUB HEAD WITH IMPROVED STRIKING FACE

CROSS-REFERENCE TO RELATED APPLICATIONS

This application is a Continuation-In-Part (CIP) of U.S. patent application Ser. No. 18/346,026, filed on Jun. 30, 2023, which is a CIP of U.S. patent application Ser. No. 17/941,418, filed on Sep. 9, 2022, which is a CIP of U.S. patent application Ser. No. 17/471,040, filed on Sep. 9, 2021, the disclosures of which are all incorporated by reference in their entirety.

FIELD OF THE INVENTION

The present invention relates generally to a golf club head with an improved striking face. More specifically, the present invention relates to a metalwood type golf club head, wherein the striking face is further comprised out of a thickened central region, located near a geometric center of the striking face portion, a central transition region extending outward radially from the thickened central region, a thinned intermediate region, extending outward radially from the central transition region, a thickened stress reducing region, extending outward radially from the thinned intermediate region, and a thinned perimeter region, extending outward radially from the thickened stress reducing region, all of which combine to form the improved striking face.

BACKGROUND OF THE INVENTION

The striking face of a golf club head is the singular component in a golf club head that experiences the highest level of stress when impacting a golf ball. Moreover, with the striking face being the only component that comes in contact with a golf ball, it is one of the key critical components to any golf club design.

In order to improve the performance of a golf club head via the striking face, golf club designers have tried to create an extremely thin striking face, allowing the striking face to elastically deform when impacting a golf ball, thus increasing the speed of a golf ball once it leaves the striking face of the golf club head; all while staying within the rules of golf. U.S. Pat. No. 4,432,549 to Zebelean illustrates one of the earlier attempts to thin out the striking face of a golf club head by thinning out the upper portion of the striking face of a golf club head Thinning out the face is not the only way to improve performance of the striking face of a golf club head, as more current improvements include the adjustment of the thickness of the various portions of the striking face to improve performance. Building upon the already thinned face, U.S. Pat. No. 6,863,626 to Evans et al. illustrates one of the earlier attempts to vary the thickness of the striking face of a golf club head by disclosing a thickened central region that decreases outward from the center, to help slow down the speed of a golf ball at the center to create a larger area of improved speed and performance.

Further building upon the known technology of a thinned face that's combined with a thickened central portion, to further improvements to the performance of the golf club head U.S. Pat. No. 10,758,789 to Bacon et al, adds a thickened perimeter region at the extremities of the striking face, which the inventors claim to improve durability, increase ball speed, and increase characteristic time. However, the addition of this, although beneficial, is not optimized because the benefit of a thickened perimeter region is generally localized and does not need to extend all the way to the perimeter of the striking face as shown by U.S. Pat. No. 10,758,789.

Hence it can be seen that further improvements can be made to golf club heads that have a thinned face, thickened central region, and have a thickened perimeter region by removing unnecessary weight from the extremities of the perimeter of the striking face, and only localizing the thickened perimeter region at optimized locations that could benefit from such feature.

BRIEF SUMMARY OF THE INVENTION

One aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise, a thickened central region, located near a geometric center of the striking face portion, having a first thickness; a central transition region, extending outward radially from the thickened central region, having a variable thickness; a thinned perimeter region, extending outward radially from the central transition region, having a third thickness; a thickened stress reducing region, extending outward radially from the thinned intermediate region, having a fourth thickness; and a thinned perimeter region, extending outward radially from thickened stress reducing region, having a fifth thickness, wherein the thickened stress reducing region forms a ring protruding rearward from the internal rear surface of the striking face portion, and wherein the fourth thickness is greater than the first thickness.

In another aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise, a thickened central region, located near a geometric center of the striking face portion, having a first thickness; a central transition region, extending outward radially from the thickened central region, having a variable thickness; a thinned perimeter region, extending outward radially from the central transition region, having a third thickness; a thickened stress reducing region, extending outward radially from the thinned intermediate region, having a fourth thickness; and a thinned perimeter region, extending outward radially from thickened stress reducing region, having a fifth thickness, wherein the thickened stress reducing region forms a ring protruding rearward from the internal rear surface of the striking face portion, wherein the fifth thickness is less than the fourth thickness, and wherein the third thickness of the thinned intermediate region is the thinnest portion of the striking face portion.

In another aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise a thickened stress reducing region, located proximate a perimeter of said striking face portion, wherein the thickened stress reducing region forms a ring protruding rearward from the internal rear surface of the striking face portion, and wherein the thickened stress reducing region is placed at a distance of between about 15 mm to about 30 mm from a geometric center of the striking face portion, measured across a vertical cross-section passing through the geometric center of the striking face portion.

In another aspect of the present invention the thickened stress reducing region forms at least a portion of a ring protruding rearward from the internal rear surface of the striking face portion.

In another aspect of the present invention, the internal rear surface can be divided into a clock grid comprising at least a 12 o'clock ray, a 1 o'clock ray, a 2 o'clock ray, a 3 o'clock ray, a 4 o'clock ray, a 5 o'clock ray, a 6 o'clock ray, a 7 o'clock ray, an 8 o'clock ray, a 9 o'clock ray, a 10 o'clock ray, and an 11 o'clock ray; wherein the thickened stress reducing region is located only at a region consisting of an upper region between the 9 o'clock ray and the 2 o'clock ray, and a lower region between the 9 o'clock ray and the 3 o'clock ray.

In another aspect of the present invention, the thickness stress reducing region has an area of reduced thickness between the 8 o'clock ray and the 10 o'clock ray forming a heel thickened stress reducing region.

In another aspect of the present invention, said thickened stress reducing region forms a horseshoe shaped ring.

In another aspect of the present invention is a golf club head further comprising of a striking face portion located at a frontal portion of the golf club head, adapted to impact a golf ball, a a body portion, attached to a rear of the striking face portion. The striking face portion further comprises of a perimeter region having a central opening, wherein the perimeter region further comprises a thickened stress reducing region, having a fourth thickness, and a face insert adapted to engage the central opening, wherein the face insert further comprises a thickened central region, located near a geometric center of the striking face portion, having a first thickness; wherein no part of the thickened stress reducing region engages the face insert, and where the fourth thickness is greater than the first thickness.

In another aspect of the present invention a top ledge of the central opening is located less than about 1.0 mm away from the crown leading edge of the striking face portion.

In another aspect of the present invention, the face insert has an aspect ratio of between about 1.3 to about 1.7.

In another aspect of the present invention, the top ledge of the central opening is located less than about 10 mm away from a crown apex.

In accordance with some aspects of the presently disclosed technology, a golf club head is disclosed. The golf club head may include a striking face portion, located at a frontal portion of the golf club head, adapted to impact a golf ball and a body portion, attached to a rear of the striking face portion. The striking face portion may further include a frontal striking surface. The frontal striking surface may be substantially planar. The striking face portion may further include a rear internal surface. The frontal striking surface and the rear internal surface may combine to further include a thickened central region, located near a geometric center of the striking face portion, having a first thickness, a central transition region, extending outward radially from the thickened central region, having a variable thickness, a thinned intermediate region, extending outward radially from the central transition region, having a third thickness, a thickened stress reducing region, extending outward radially from the thinned intermediate region, having a fourth thickness, and a thinned perimeter region, extending outward radially from the thickened stress reducing region, having a fifth thickness. The thickened stress reducing region may include a pocket exposing a faceward portion of the thickened stress reducing region and a weight to fit into the pocket. The fourth thickness may be greater than the first thickness.

In embodiments, the pocket may be located near a bottom portion of the striking face portion.

In embodiments, the pocket may be located on a faceward-most portion of the striking face portion.

In embodiments, the pocket may be equal to or less than a half of a perimeter of the thickened stress reducing region.

In embodiments, the pocket may be equal to or less than a quarter of a perimeter of the thickened stress reducing region.

In embodiments, the weight may include a metal.

In embodiments, the metal may be tungsten.

In embodiments, the thickened stress reducing region may have a T over H ratio of between about 0.6 to 1.1, the T over H ratio defined as;

$$T \text{ over } H \text{ Ratio} = \frac{\text{Thickness } T4 \text{ of Thickened Stress Reducing Region}}{\text{Height } H4 \text{ of Thickened Stress Reducing Region}}.$$

In embodiments, the T over H ratio may be between about 0.7 to about 0.9.

In embodiments, the T over H ratio may be about 0.8.

In accordance with some aspects of the presently disclosed technology, a golf club head is disclosed. The golf club head may include a striking face portion, located at a frontal portion of the golf club head, adapted to impact a golf ball and a body portion, attached to a rear of the striking face portion. The striking face portion may further include a frontal striking surface. The frontal striking surface may be substantially planar. The striking face portion may further include a rear internal surface. The frontal striking surface and the rear internal surface may combine to further include a thickened stress reducing region, extending outward radially from the thinned intermediate region, having a fourth thickness and a thickened central region, located near a geometric center of the striking face portion, having a first thickness. The thickened stress reducing region may include a pocket exposing a faceward portion of the thickened stress reducing region and a weight to fit into the pocket. The fourth thickness may be greater than the first thickness.

In embodiments, the pocket may be located near a bottom portion of the striking face portion.

In embodiments, the pocket may be located on a faceward-most portion of the striking face portion.

In embodiments, the pocket may be equal to or less than a half of a perimeter of the thickened stress reducing region.

In embodiments, the pocket may be equal to or less than a quarter of a perimeter of the thickened stress reducing region.

In embodiments, the weight may include a metal.

In embodiments, the metal may be tungsten.

In accordance with some aspects of the presently disclosed technology, a golf club head is disclosed. The golf club head may include a striking face portion, located at a frontal portion of the golf club head, adapted to impact a golf ball and a body portion, attached to a rear of the striking face portion. The striking face portion may further include a perimeter region having a central opening. The perimeter region may include a thickened stress reducing region, having a fourth thickness. The thickened stress reducing region may include a pocket exposing a faceward portion of the thickened stress reducing region and a weight to fit into the pocket. The striking face portion may include a face insert adapted to engage the central opening. The face insert may include a thickened central region, located near a geometric center of the striking face portion, having a first thickness. The fourth thickness may be greater than the first thickness.

In embodiments, the pocket may be located on a faceward-most portion of said striking face portion.

In embodiments, the pocket may be equal to or less than a half of a perimeter of the thickened stress reducing region.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below, and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
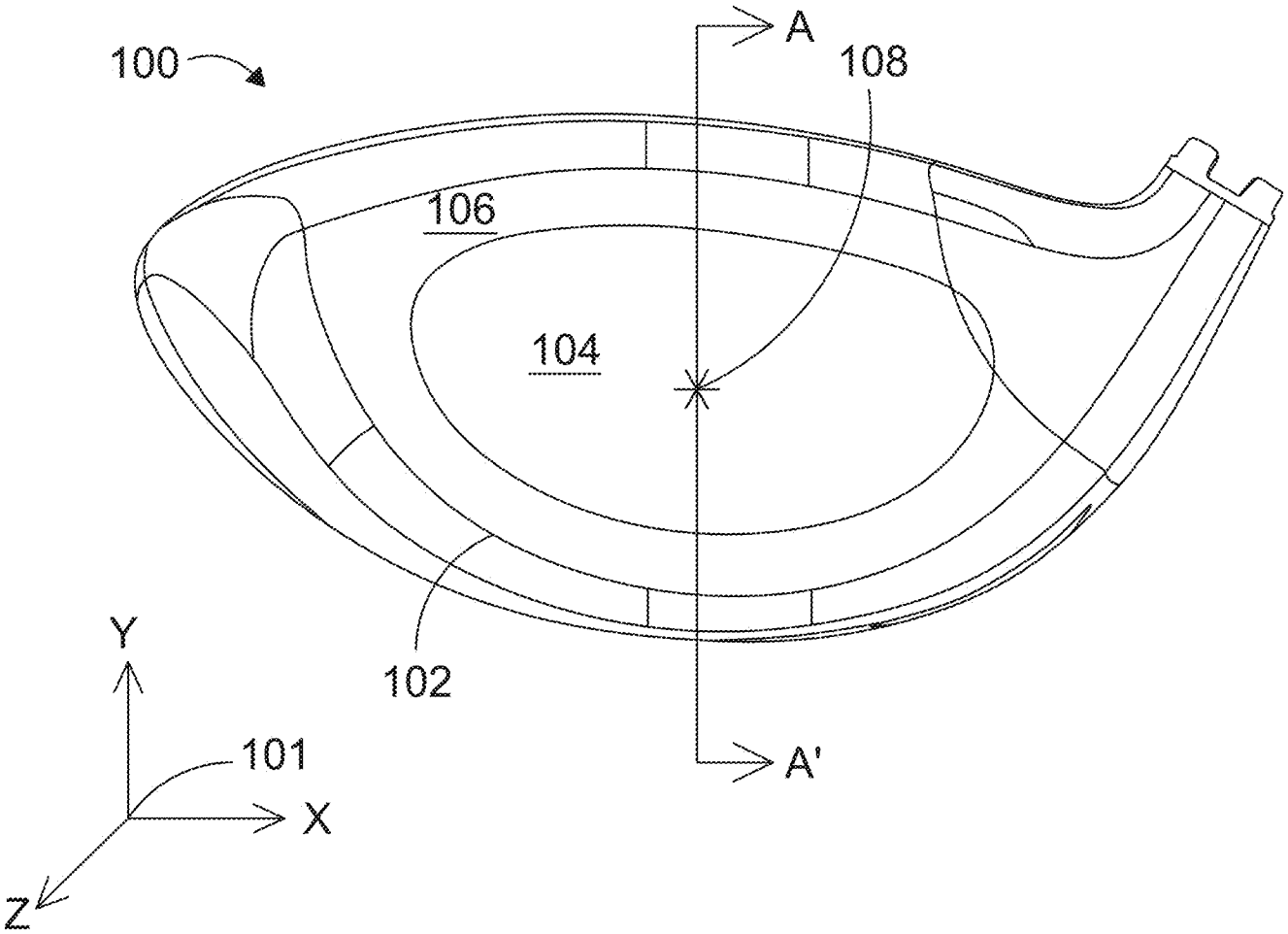
FIG. 1 of the accompanying drawings shows a frontal view of a golf club head in accordance with an exemplary embodiment of the present invention, allowing cross-sectional line A-A' to be shown.

FIG. 1 of the accompanying drawings shows a frontal view of a golf club head 100 in accordance with an exemplary embodiment of the present invention. First and foremost, FIG. 1 of the accompanying drawings shows a coordinate system 101, which defines the orientation of the golf club head 100 along the x, y, and z axes. The x-axis shown here is horizontal and spans in a heel to toe direction, with the positive axis pointing to the heel of the golf club head 100. The y-axis shown here is vertical and spans in a crown to sole direction, with the positive axis pointing to the crown of the golf club head 100. Finally, the z-axis shown here refers to the axis that points in and out of the page, and spans in a forward and back direction, with the positive axis pointing towards the front of the golf club head 100. This frontal view of the golf club head 100 shows the striking face portion 102, which in this embodiment is further comprised out of a face insert 104 and a face perimeter 106. FIG. 1 of the accompanying drawings also shows a cross-sectional line A-A' vertically along the y axis, along the y-z plane, allowing the internal geometry of the striking face portion 102 to be shown more clearly.

Figure 2:
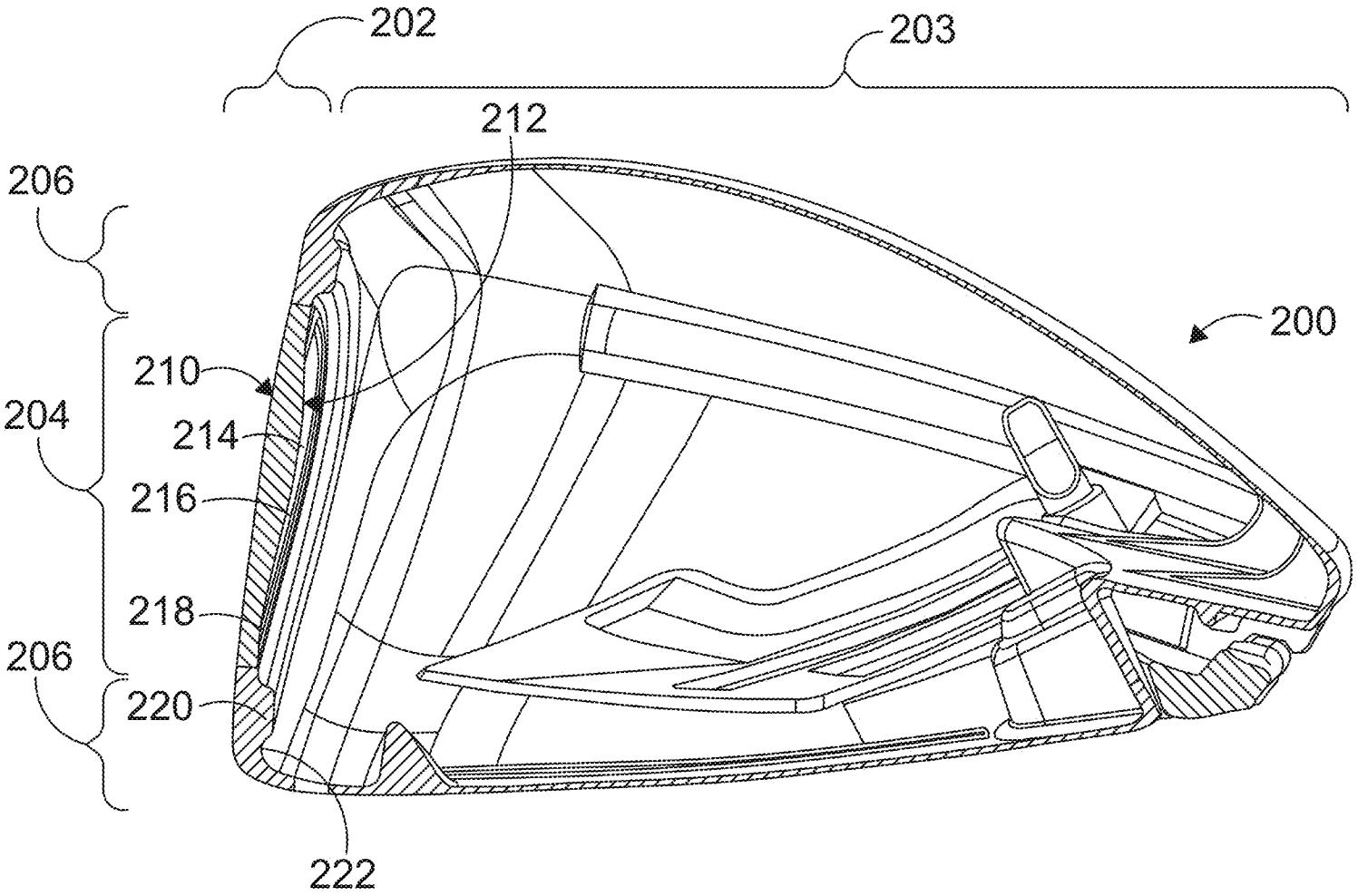
FIG. 2 of the accompanying drawings shows a cross-sectional view of a golf club head in accordance with an exemplary embodiment of the present invention, taken along cross-sectional line A-A' shown in FIG. 1.

FIG. 2 of the accompanying drawings shows a cross-sectional view of a golf club head 200, taken along cross-sectional line A-A' shown in FIG. 1. In this cross-sectional view of the golf club head 200 shown in FIG. 2, we can see that the golf club head 200 is has a striking face portion 202 and a rear body portion 203, attached to the rear of the striking face portion 202. The striking face portion 202, as defined in the present invention, refers to the portion of the golf club head 200 that is substantially planar, and located at the frontal portion of the golf club head 200, adapted to strike a golf ball. The striking face portion 202 is formed by the thickness created by a substantially planar frontal striking surface 210 and a rear internal surface 212 having a variable contour, thus creating a striking face portion with a variable face thickness profile. The demarcation between the striking face portion 202 and the rear body portion 203 occurs when the rear internal surface 212 deviates from a substantially planar vertical orientation towards a substantially horizontal orientation.

Finally, FIG. 2 of the accompanying drawings shows that in this embodiment, a face insert 204 is used and it closes an opening in the striking face portion 202 created by the face perimeter 206. In this embodiment of the present invention, the face insert 204 may generally be made from a titanium material for its light weight and high durability characteristics; and may generally be significantly thinner than traditional golf club heads having a similar construction due to the unique thickened stress reducing region 216 around the face perimeter 206. In this embodiment of the present invention, the thickened stress reducing region 220 around the face perimeter 206 allows for the face insert 204 to be thinner and lighter, yielding a mass of less than about 25 grams, more preferably less than about 24 grams, and most preferably less than about 23 grams, all without departing from the scope and content of the present invention. Compared to a face insert installed without the thickened stress reducing region 220 around the face perimeter 206, the mass of the face insert is decreased by approximately 12 grams.

Figure 3:
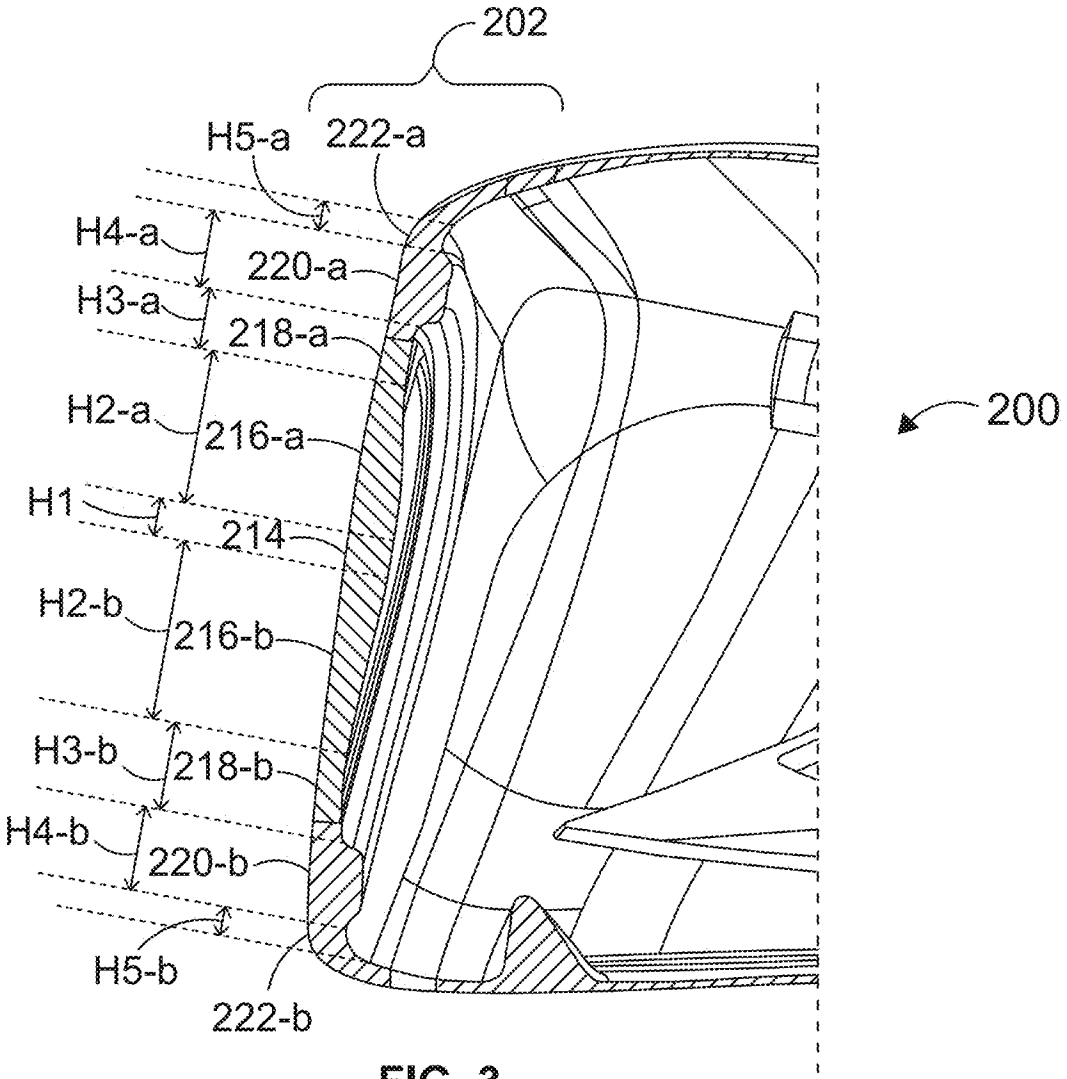
FIG. 3 of the accompanying drawings shows an enlarged cross-sectional view of a striking face portion of a golf club head in accordance with an exemplary embodiment of the present invention shown in FIG. 2.

In order to illustrate more detail regarding the thickened stress reducing region 220 around the face perimeter 206 together with the remainder of the striking face portion 202 geometry such as the thickened central region 214, the central transition region 216, the thinned intermediate region 216, and the thinned perimeter region 222, an enlarged view of the striking face portion 202 is provided in FIG. 3.

FIG. 3 of the accompanying drawings shows an enlarged cross-sectional view of the striking face portion 202 of a golf club head 200. This enlarged cross-sectional view allows the various heights of the striking face portion 202 to be shown more clearly, while FIG. 4 of the accompanying drawings will illustrate the various thicknesses of the striking face portion 202. In accordance with this shown exemplary embodiment of the present invention, the striking face portion 202 is further comprised of a thinned upper perimeter region 222-*a* and a thinned lower perimeter region 222-*b*, combining to form a thinned perimeter region 222. Located inward from the thinned perimeter region, the striking face portion 202 has an upper thickened stress reducing region 220-*a* and a lower thickened stress reducing region 220-*b* combining to form a thickened stress reducing region 220. Alternatively speaking, it can be said that the thickened stress reducing region 220 forms a ring that protrudes rearward from the internal surface 212 of the striking face portion 202. Located inward from the thickened stress reducing region, the striking face portion 202 has an upper thinned intermediate region 218-*a* and a lower thinned intermediate region 218-*b*, combining to form a thinned intermediate region 218. Located inward from the thinned intermediate region, the striking face portion 202 has an upper central transition region 216-*a* and a lower central transition region 216-*b*, combining to form the central transition region 216. Finally, the striking face portion 202 has a thickened central region 214 located inward of the central transition region 214.

In this embodiment of the present invention shown in FIG. 3, the height H1 of the thickened central region 214 may generally be between about 4.0 mm and about 15.0 mm, more preferably between about 4.0 mm and about 10.0 mm, and most preferably about 4.0 mm.

The height of the central transition region 216, in accordance with this embodiment of the present invention, may also be greater below the thickened central region 214 than above the thickened central region 214. Hence, in accordance with this embodiment, the height H2-*a* of the upper central transition region 216-*a* is between about 7.0 mm and about 11.0 mm, more preferably between about 8.0 mm and about 10.0 mm, and most preferably about 9.0 mm. The height H2-*b* of the lower central transition region 216-*b* may generally be between about 13.0 mm to about 17.0 mm, more preferably between about 14.0 mm to about 16.0 mm, and most preferably about 15.0 mm. However, it should be noted that in alternative embodiments, the height of the upper central transition region 216-*a* and the lower central transition region 216-*b* may be the same without departing from the scope and content of the present invention.

The height of the thinned intermediate region 218, in accordance with this embodiment of the present invention, may also be greater below the thickened central region 214 than above the thickened central region 214. Hence, in accordance with this embodiment, the height H3-*a* is generally between about 3.5 mm and about 5.5 mm, more preferably between about 4.0 mm and about 5.0 mm, and most preferably about 4.5 mm. The height H3-*b* of the lower central transition region 218-*b* may generally be between about 6.5 mm to about 8.5 mm, more preferably between about 7.0 mm to about 8.0 mm, and most preferably about 7.5 mm. However, it should be noted that in alternative embodiments, the height of the upper central transition region 218-*a* and the lower central transition region 218-*b* may be the same without departing from the scope and content of the present invention.

The height of the thickened stress reducing region 220, different from previous measurements, is the same measurement irrespective of whether the measurement is for the upper thickened stress reducing region 220-*a* or the lower thickened stress reducing region 220-*b*. Hence, in accordance with this embodiment, the height H4-*a* and H4-*b* are both between about 4.0 mm and about 6.0 mm, more preferably between about 4.5 mm and about 5.5 mm, and most preferably about 5.0 mm. Similar to the logic above, having different H4-*a* and H4-*b* values also does not deviate from the scope and content of the present invention, so long as both fall within the ranges articulated above. It is worth noting here that the height of the thickened stress reducing region 220 is critical to the proper functionality of the present invention, as it carefully balances the need to not add too much unnecessary mas to the striking face portion 202, but also the need to provide enough structural rigidity to reduce the stress from the face perimeter 106 (shown in FIG. 1) to allow the remainder of the striking face portion 202 to be made thinner and more efficient. The height of the thickened stress reducing region 220, combined with the thickness of the thickened stress reducing region 220 (to be discussed later in FIG. 4), will outline the optimized geometry to achieve the performance gains of the present invention.

Before moving on to a discussion regarding the thinned perimeter region 222, it is important to note that the placement of the thickened stress reducing region 220 relative to the geometric face center 108 (shown in FIG. 1) is critical to the achieve the proper performance gains in the present invention. This is especially true along the vertical cross-sectional plane passing through the geometric face center 108 (shown in FIG. 1) as shown here in the enlarged cross-sectional view shown in FIG. 3. The criticality of this specific cross-section, and the placement of the thickened stress reducing region 220 along this cross-section, derives from the tendency of the striking face portion 202 to exhibit higher stress risers in the upper face portion along this plane; hence the addition of the thickened stress reducing region 220. In this embodiment of the present invention, the thickened stress reducing region 220 may generally be placed at a distance of between about 15 mm to about 30 mm away from the geometric face center 108, along the cross-sectional plane A-A', more preferably placed at a distance of between about 17 mm to about 28 mm away from the geometric face center 108 (shown in FIG. 1), along the cross-sectional plane A-A', and most preferably between about 20 mm to about 25 mm away from the geometric face center 108 (shown in FIG. 1), along the cross-sectional plane A-A'.

The height of the thinned perimeter region 222, may also be greater below the thickened central region 214 than above the thickened central region 214. Hence, in accordance with this embodiment, the height H5-*a* is between about 1.8 mm and about 2.8 mm, more preferably between about 2.1 mm and about 2.5 mm, and most preferably about 2.3 mm. The height H5-*b* may generally be between about 2.3 mm to about 3.3 mm, more preferably between about 2.6 mm to about 3.0 mm, and most preferably about 2.8 mm. However, it should be noted that in alternative embodiments, the height of the upper thinned perimeter region 222-*a* and the lower thinned perimeter region 222-*b* may be the same without departing from the scope and content of the present invention.

Figure 4:
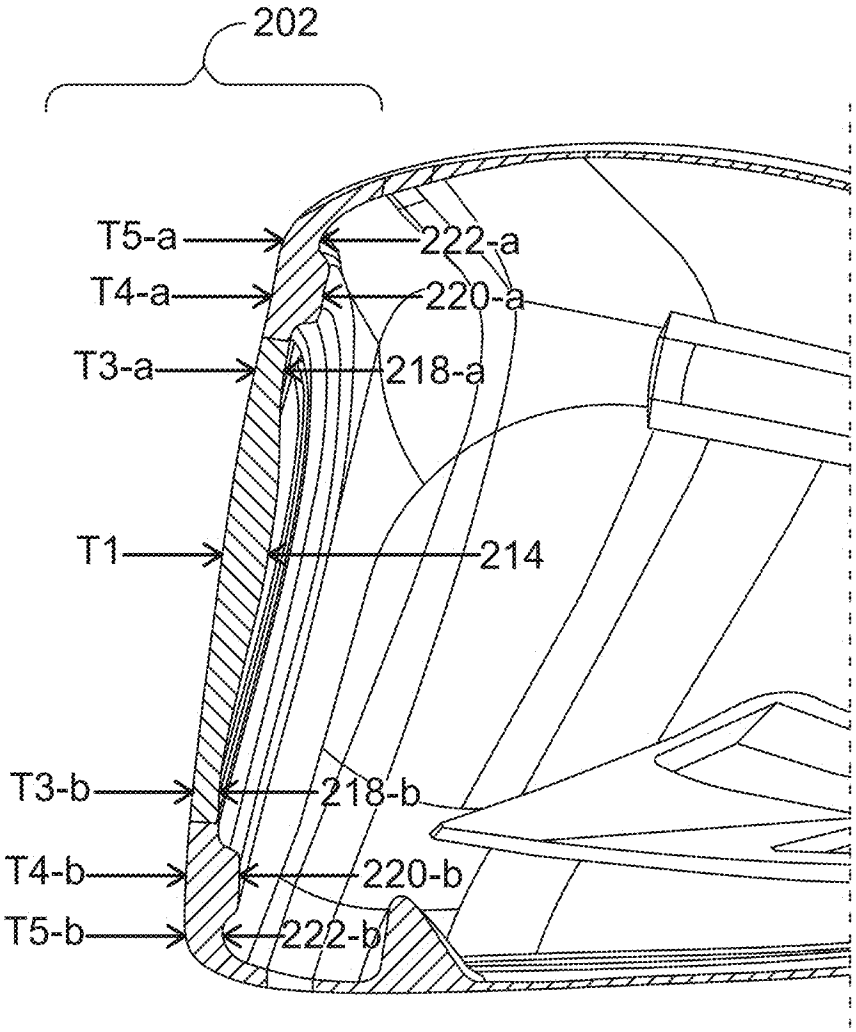
FIG. 4 of the accompanying drawings, again, shows an enlarged cross-sectional view of a striking face portion of a golf club head in accordance with an exemplary embodiment of the present invention shown in FIG. 2, allowing different features to be highlighted.

FIG. 4 of the accompanying drawings shows another enlarged cross-sectional view of the striking face portion 202 of a golf club head 200. In this cross-sectional view, the various thicknesses of the components of the striking face portion 202 is shown in more detail. In this current embodiment of the present invention, the thickened central region 214 may generally have a thickness T1 of less than about 3.6 mm, more preferably less than about 3.4 mm, and most preferably less than about 3.2 mm; as the goal of the present invention is to minimize the thickness of various components of striking face portion 202, via the introduction of the thickened stress reducing region 220 that alleviate stress on the striking face portion 202.

The thickness of the thinned intermediate region 218 may generally be the same irrespective of whether it's located at the upper thinned intermediate region 218-*a* or the lower thinned intermediate region 218-*b*. Hence, the thickness T3-*a* and T3-*b* are both less than about 2.5 mm, more preferably less than about 2.4 mm, and most preferably less than about 2.3 mm. However, in alternative embodiments of the present invention, T3-*a* and T3-*b* values may be slightly different from one another and will not deviate from the scope and content of the present invention, so long as both fall within the ranges articulated above.

The thicknesses of the thickened stress reducing region 220, shown here as an upper thickened stress reducing region 220-*a* having a thickness T4-*a* and lower thickened stress reducing region 220-*b* having a thickness T4-*b*, combines with the width of the thickened stress reducing region 220 define a geometry that is critical to the improved performance of the striking face portion 202 of the golf club head. In this embodiment, the thicknesses T4-*a* and T4-*b*, for the upper thickened stress reducing region 220-*a* and lower thickened stress reducing region 220-*b* respectively, are both the same, hence yielding a thickness of between about 3.6 mm to about 4.4 mm, more preferably between about 3.8 mm top about 4.2 mm, and most preferably about 4.0 mm. However, in alternative embodiments of the present invention, the thicknesses T4-*a* and T4-*b* could deviate slightly from one another without departing from the scope and content of the present invention, so long as it does not fall outside the scope of the thickness ranges defined above.

Once the thickness T4 and the height H4 of the thickened stress reducing region 220 have been defined, a preferred geometric shape of the thickened stress reducing region 220 can be established as a ratio of the thickness and the height. The preferred geometric shape will have a T over H Ratio defined by Equation (1) below:

$$T \text{ over } H \text{ ratio} = \frac{\text{Thickness } T4 \text{ of Thickened Stress Reducing Region}}{\text{Height } H4 \text{ of Thickened Stress Reducing Region}} \quad \text{Eq. (1)}$$

The T over H Ratio of the thickened stress reducing region 220 of the striking face portion 202 in accordance with the present invention may generally be between about 0.6 to about 1.1, more preferably between about 0.7 to about 0.9, and most preferably about 0.8. Once again, as previously mentioned, this ratio is critical to achieving the stress reducing properties of the striking face portion 202, all while minimizing the unnecessary mass added by the addition of this thickened stress reducing region 220.

The thickness of the thinned perimeter region 222 may generally be the same irrespective of whether it's located at the upper thinned perimeter region 22-*a* or the lower thinned perimeter region 222-*b*. Hence, the thickness T5-*a* and T5-*b* are both less than about 3.0 mm, more preferably less than about 2.8 mm, and most preferably less than about 2.7 mm. However, in alternative embodiments of the present invention, T5-*a* and T5-*b* values may be slightly different from one another and will not deviate from the scope and content of the present invention, so long as both fall within the ranges articulated above.

Another important relationship worth highlighting here is the thickness T4 of the thickened stress reducing region 720 versus the thickness T1 of the thickened central region 714. Because the introduction of the thickened stress reducing region 720 greatly decreases the overall thickness and mass of the entire striking face portion 702, the resultant relationship between the two thicknesses is critically important to achieving the improved performance of the present invention. In this exemplary embodiment of the present invention, the ratio of T4 divided by T1 is generally greater than about 1, more preferably greater than about 1.15, and most preferably greater than about 1.375. Alternatively speaking, it can be said that the thickness T4 of the thickened stress reducing region 220 is greater than a thickness T1 of the thickened central region 214, or any other location along the entirety of the striking face portion 202. The thickest portion of the striking face portion 202 is located on the thickened stress reducing region 220.

Figure 5:
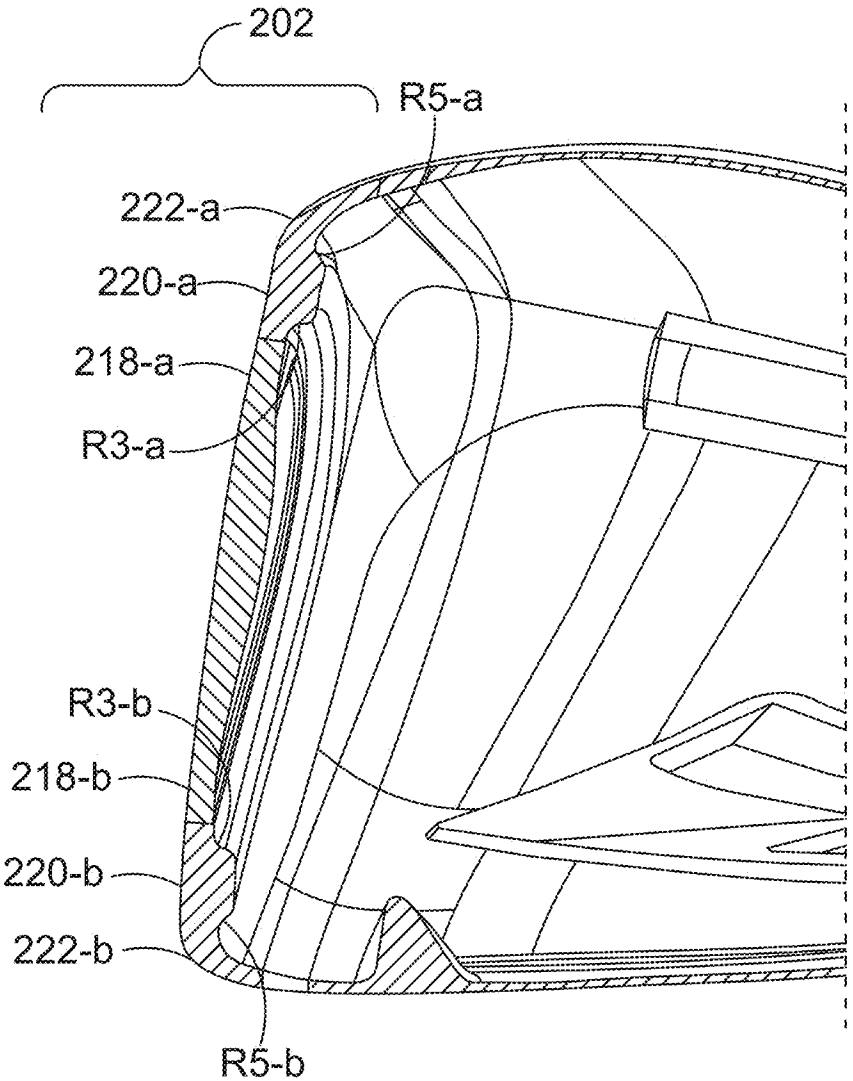
FIG. 5 of the accompanying drawings, once again, shows an enlarged cross-sectional view of a striking face portion of a golf club head in accordance with an exemplary embodiment of the present invention shown in FIG. 2, allowing different features to be highlighted.

FIG. 5 of the accompanying drawings shows that same enlarged cross-sectional view of the striking face portion 202 of a golf club head 200 as FIGS. 3 and 4, but this time focusing on the transition of the thickened stress reducing region 220 to its neighboring thinned intermediate region 218 and thinned perimeter region 222. In this embodiment of the present invention, the various radii around the thickened stress reducing region 220 is also critical to the proper functionality of the present invention, as undesirable radii not only does not serve the purpose of reducing stress but could also add to the manufacturing challenges. On top of everything, the radii also needs to be a balance of, on one hand, minimizing the undesirable weight additions attributed to the addition of the thickened stress reducing region 220, and on the other hand the stress and manufacturing challenges attributed to the thickened stress reducing region 220.

Radius R5-*a* and Radius R5-*b* indicate the radius of curvature or the blend from the thickened stress reducing region 220-*a* and 220-*b* towards the thinned perimeter region 222-*a* and 222-*b*. R5-*a* and R5-*b* in this embodiment may generally be the same number and is generally between about 1.0 mm and about 1.4 mm, more preferably between about 1.1 mm and about 1.3 mm, and most preferably about 1.2 mm. However, it should be noted that in alternative embodiments of the present invention R5-*a* and R5-*b* may be different from one another without departing from the scope and content of the present invention so long as it falls within the radius ranges articulated above.

Radius R3-*a* and Radius R3-*b* indicate the radius of curvature or the blend from the thickened stress reducing region 220-*a* and 220-*b* towards the thinned intermediate region 218-*a* and 218-*b*. R3-*a* and R3-*b* in this embodiment may generally be the same number and also the same as the R5-*a* and R5-*b* above between about 1.0 mm and about 1.4 mm, more preferably between about 1.1 mm and about 1.3 mm, and most preferably about 1.2 mm. However, it should be noted that in alternative embodiments of the present invention R3-*a* and R3-*b* may be different from one another without departing from the scope and content of the present invention so long as it falls within the radius ranges articulated above.

It is worth noting here that the radius of the blend from the thickened stress reducing region 220 towards the thinned perimeter region 222 and the thinned intermediate region 218, shown as R5 and R3 respectively, may generally be the same as one another. However, as previously mentioned, in alternative embodiments of the present invention, these numbers could differ from one another without departing from the scope and content of the present invention so long as they fall within the ranges above.

Figure 6A:
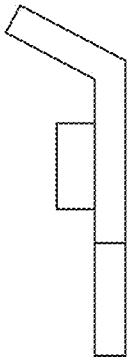
FIG. 6*a* of the accompanying drawing shows a representative cross-sectional view of a thickened stress reducing region accordance with an exemplary embodiment of the present invention.
Figure 6B:
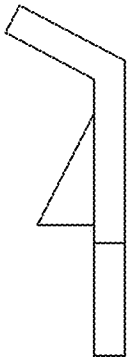
FIG. 6*b* of the accompanying drawings shows a representative cross-sectional view of a thickened stress reducing region in accordance with an alternative embodiment of the present invention.
Figure 6C:
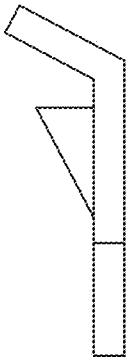
FIG. 6*c* of the accompanying drawings shows a representative cross-sectional view of a thickened stress reducing region in accordance with an even further alternative embodiment of the present invention.
Figure 6D:
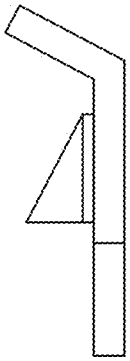
FIG. 6*d* of the accompanying drawings shows a representative cross-sectional view of a thickened stress reducing region in accordance with an even further alternative embodiment of the present invention.
Figure 6E:
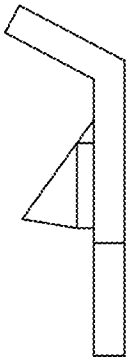
FIG. 6*e* of the accompanying drawings shows a representative cross-sectional view of a thickened stress reducing region in accordance with an even further alternative embodiment of the present invention.
Figure 6F:
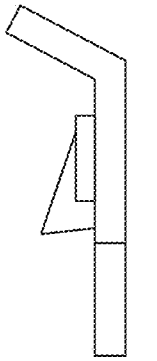
FIG. 6*f* of the accompanying drawings shows a representative cross-sectional view of a thickened stress reducing region in accordance with an even further alternative embodiment of the present invention.
Figure 6G:
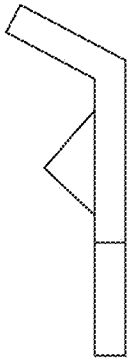
FIG. 6*g* of the accompanying drawings shows a representative cross-sectional view of a thickened stress reducing region in accordance with an even further alternative embodiment of the present invention.
Figure 6H:
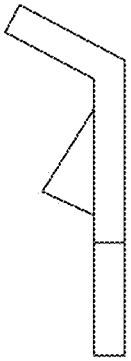
FIG. 6*h* of the accompanying drawings shows a representative cross-sectional view of a thickened stress reducing region in accordance with an even further alternative embodiment of the present invention.
Figure 6I:
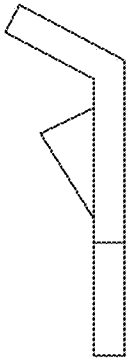
FIG. 6*i* of the accompanying drawings shows a representative cross-sectional view of a thickened stress reducing region in accordance with an even further alternative embodiment of the present invention.
Figure 6J:
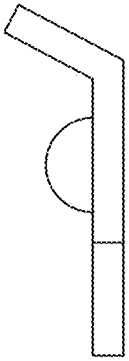
FIG. 6*j* of the accompanying drawings shows a representative cross-sectional view of a thickened stress reducing region in accordance with an even further alternative embodiment of the present invention.
Figure 6K:
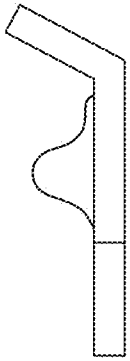
FIG. 6*k* of the accompanying drawings shows a representative cross-sectional view of a thickened stress reducing region in accordance with an even further alternative embodiment of the present invention.
Figure 6L:
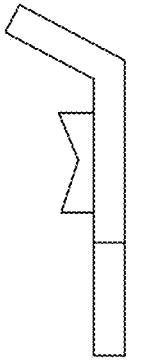
FIG. 6L of the accompanying drawings shows a representative cross-sectional view of a thickened stress reducing region in accordance with an even further alternative embodiment of the present invention.

FIGS. 6*a* through 6L of the accompanying drawings shows alternate geometries for the thickened stress reducing region 220. In FIG. 6*a*, a substantially rectangular design is shown here, like the design previously shown that added the transition radii. FIG. 6*b* of the accompanying drawings shows an alternate outward taper design of the thickened stress reducing region 220 in accordance with an alternative embodiment of the present invention. FIG. 6*c* of the accompanying drawings shows an alternate inward taper design of the thickened stress reducing region 220 in accordance with an alternative embodiment of the present invention. FIG. 6*d* of the accompanying drawings shows an alternate outward taper with constant offset design of the thickened stress reducing region 220 in accordance with an alternative embodiment of the present invention. FIG. 6*e* of the accompanying drawings shows an alternate outward taper with inner offset design of the thickened stress reducing region 220 in accordance with an alternative embodiment of the present invention. FIG. 6*f* of the accompanying drawings shows an alternate outward taper with outer offset design of the thickened stress reducing region 220 in accordance with an alternative embodiment of the present invention. FIG. 6*g* of the accompanying drawings shows an alternate triangular chevron design of the thickened stress reducing region 220 in accordance with an alternative embodiment of the present invention. FIG. 6*h* of the accompanying drawings shows an alternate inward offset triangular chevron design of the thickened stress reducing region 220 in accordance with an alternative embodiment of the present invention. FIG. 6*i* of the accompanying drawings shows an alternate outward offset triangular chevron design of the thickened stress reducing region 220 in accordance with an alternative embodiment of the present invention. FIG. 6*j* of the accompanying drawings shows an alternate hemisphere design of the thickened stress reducing region 220 in accordance with an alternative embodiment of the present invention. FIG. 6*k* of the accompanying drawings shows an alternate organic design of the thickened stress reducing region 220 in accordance with an alternative embodiment of the present invention. FIG. 6L of the accompanying drawings shows an alternate depression channel taper design of the thickened stress reducing region 220 in accordance with an alternative embodiment of the present invention.

Figure 7A:
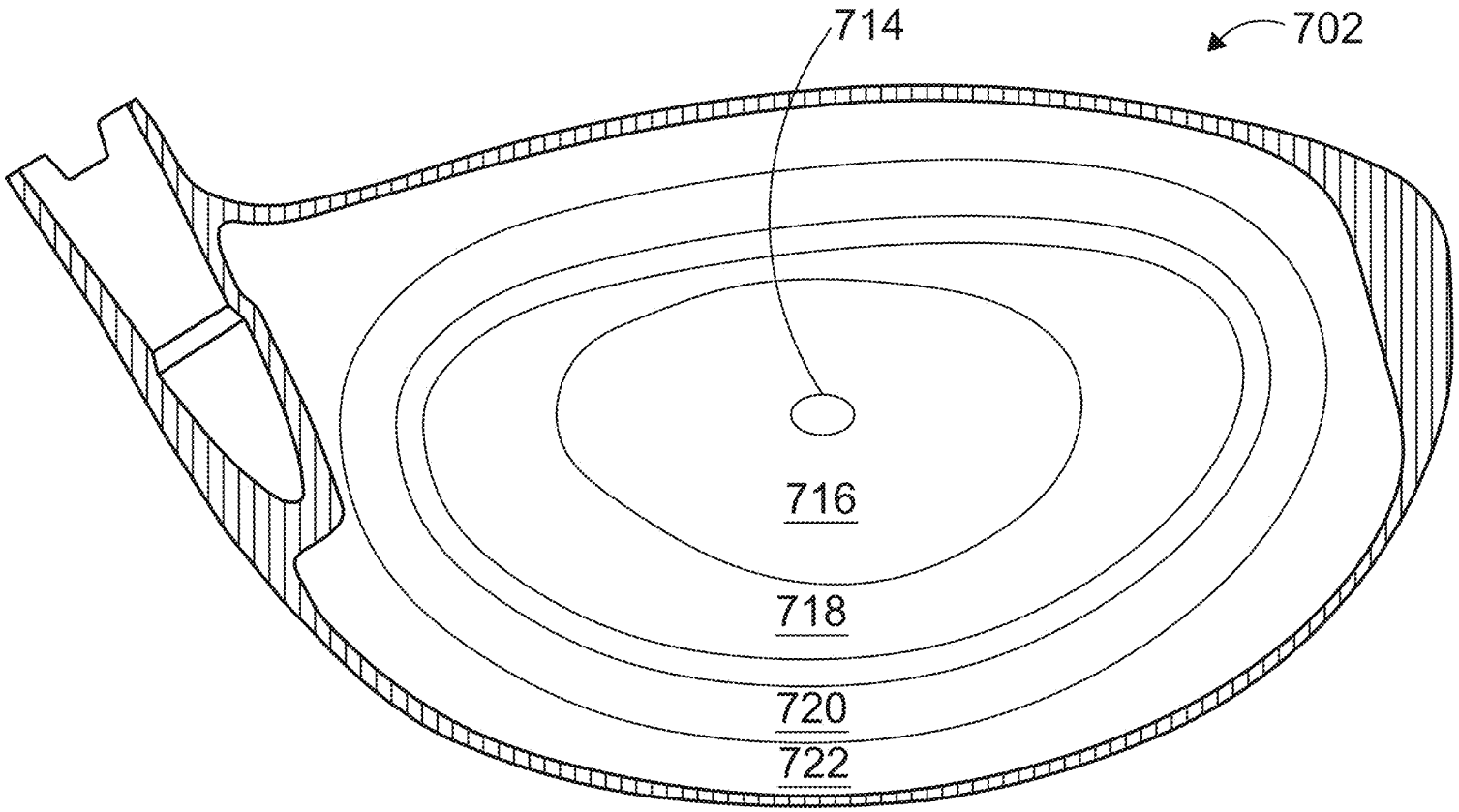
FIG. 7*a* of the accompanying drawings shows a rear shaded view of a striking face portion of a golf club head in accordance with an exemplary embodiment of the present invention.
Figure 7B:
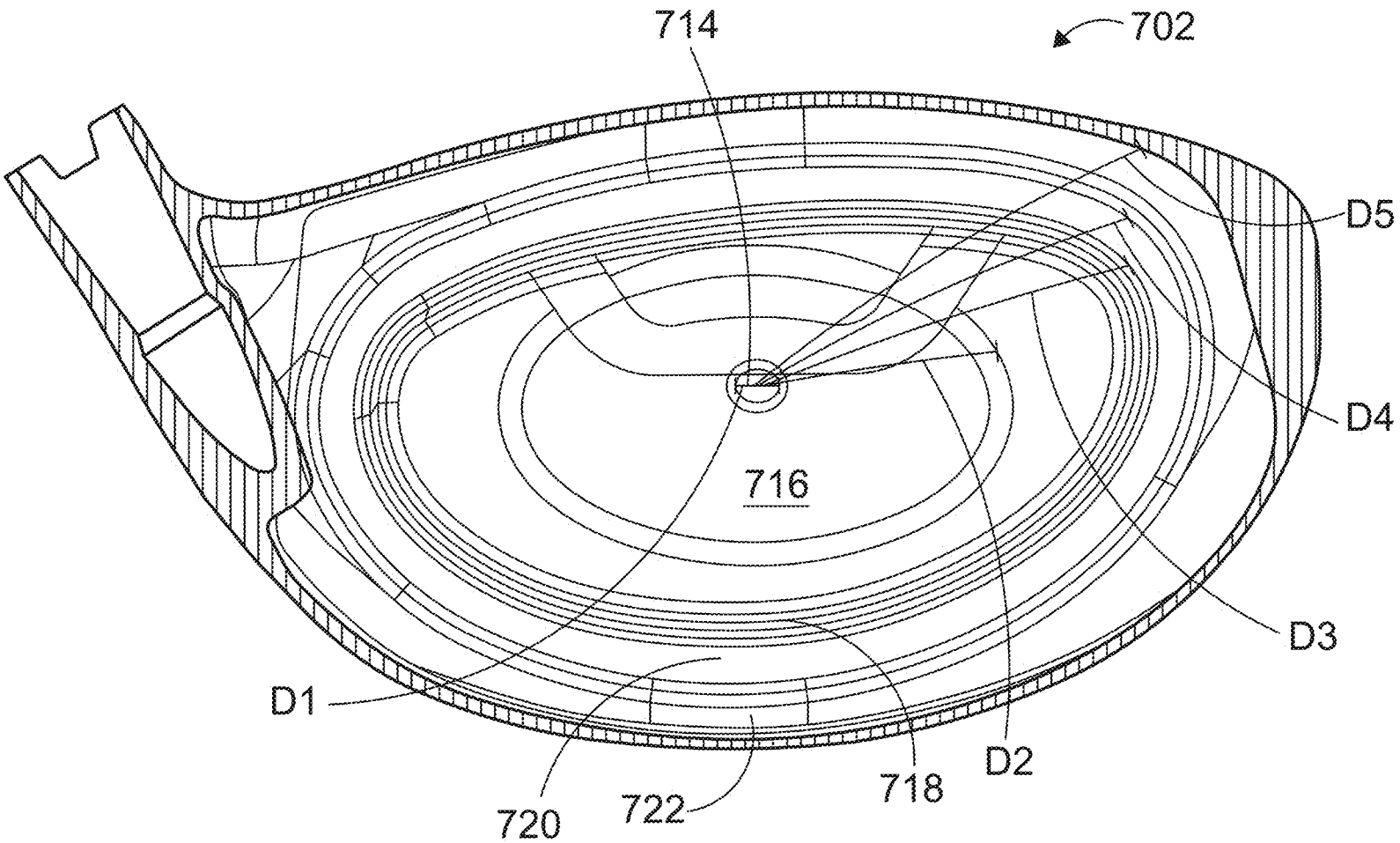
FIG. 7*b* of the accompanying drawings shows a rear view of a striking face portion of a golf club head in accordance with an exemplary embodiment of the present invention.

FIGS. 7*a* and 7*b* show a rear view of the striking face portion 702 of a golf club head in accordance with an exemplary embodiment of the present invention. In FIG. 7*a*, a view is presented to provide a better visual of the various components of the striking face portion 702. In FIG. 7*a*, a thinned perimeter region 722 forms the outer perimeter of the striking face portion 702. Inward from the thinned perimeter region 722, we can see the thickened stress reducing region 720. Inward from the thickened stress reducing region 720 is the thinned intermediate region 718. Inward from the thinned intermediate region 718 is the central transition region 716. Finally, at the geometric center of the striking face portion 702 is the thickened central region 714. In addition to illustrating the various components of the striking face portion 702, FIG. 7*a* also illustrates how the height of the various components can vary depending on where it is located on the face, and the previous measurements of the various component heights were only referring to a cross-sectional plane along the geometric center of the face as shown in FIG. 1. In one example, once can see that the height of the intermediate transition region 718 is generally smaller at the crown and sole portion of the striking face portion 702 when compared to the height of the intermediate transition region 718 at the heel and toe portion of the striking face portion 702.

Alternatively speaking, it can be said that the striking face comprises a thickened central region 714 located near a geometric center of the striking face portion 702, a central region 716 extending outward radially from the thickened central region 714, a thinned intermediate region 718, extending outward radially from the thickened central region 714, a thickened stress reducing region 720 extending outward radially from the thinned intermediate region 714, and finally a thinned perimeter region 722 extending outward radially from the thickened stress reducing region 720.

To better illustrate the differences of the height of the various components along different portions of the face, a non-shaded rear view of the striking face portion 702 is provided in FIG. 7*b*. In addition to the above, FIG. 7*b* allows the radial distances of the various components to be shown in more detail, as all measurements are taken from the geometric face center 108 (shown in FIG. 1) of the face; like the previous discussion regarding the location of the thickened stress reducing region 220 in FIG. 2. However, the distances provided here are not constrained in any specific cross-sectional plane A-A' like the previous discussion in FIG. 2, but rather a measurement of the minimum and maximum distances in any radial direction. In this rear view of the striking face portion 702 shown in FIG. 7*b*, we can see that the outer perimeter of the thickened central region 714 is generally located within a projected distance D1 of between about 4.00 mm and about 14.0 mm from a geometric face center across any radial direction. The outer perimeter of the central transition region 716 may generally be located at a distance D2 of between about 13.0 mm and about 30.0 mm from the geometric face center across any radial direction. The outer perimeter of the thinned intermediate region 718 may generally be located at a distance D3 of between about 17.0 mm and about 40.0 mm from the face center across any radial direction. The outer perimeter of the thickened stress reducing region 720 may generally be located at a distance D4 of between about 15.0 mm and about 46.0 mm from the face center across any radial direction. Finally, the outer perimeter of the thinned perimeter region 722 may generally be located at a distance D5 of between about 25.50 mm and about 55.5 mm from the face center across any radial direction.

Figure 8:
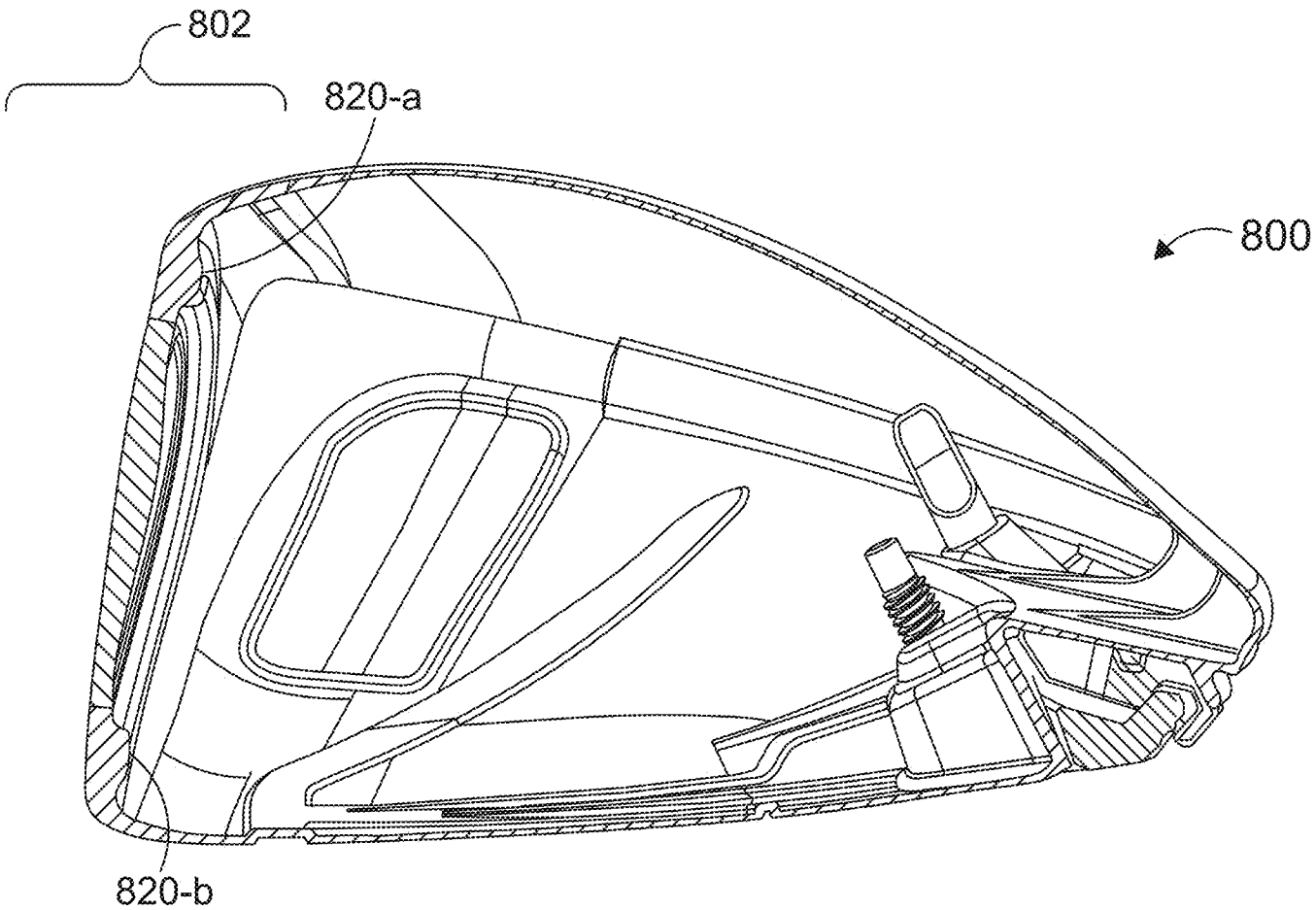
FIG. 8 of the accompanying drawings shows a cross-sectional view of a golf club head in accordance with a further alternative embodiment of the present invention, taken along cross-sectional line A-A' shown in FIG. 1.

FIG. 8 of the accompanying drawings shows a cross-sectional view of a golf club head 800, in accordance with an alternative embodiment of the present invention, taken along cross-sectional line A-A' shown in FIG. 1. In this cross-sectional view of the present invention, the shape and geometry of upper thickened stress reducing region 820-*a* is changed to be different from the lower thickened stress reducing region 820-*b* to help address high stress levels that generally occur in the upper crown region of the striking face portion 802. In order to illustrate this difference in height and radius of curvature of the blend between the upper thickened stress reducing region 820-*a* and the lower thickened stress reducing region 820-*b*, an enlarged view of the striking face portion 802 is provided in FIG. 9.

Figure 9:
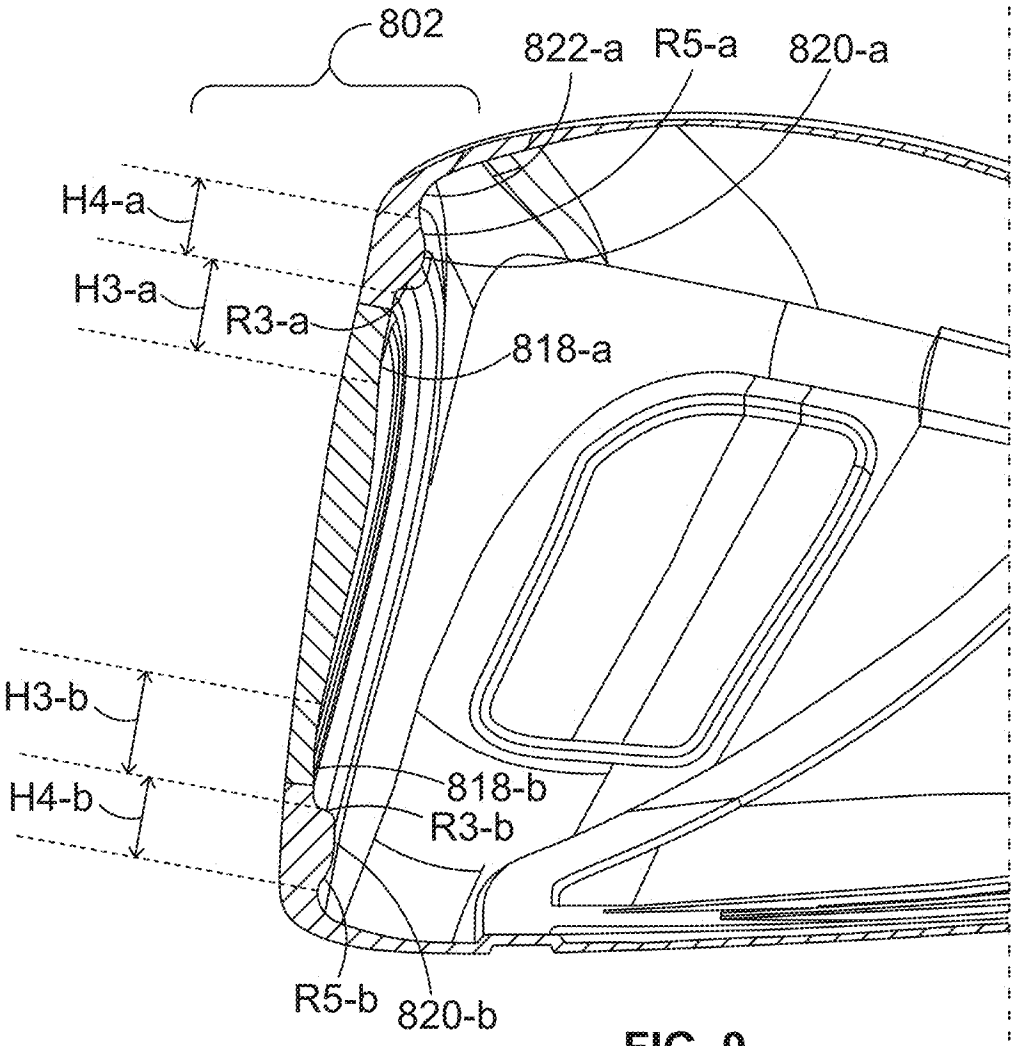
FIG. 9 of the accompanying drawings shows an enlarged cross-sectional view of a striking face portion of a golf club head in accordance with an alternative embodiment of the present invention shown in FIG. 8.

FIG. 9 of the accompanying drawings shows an enlarged view of the cross-sectional view of the striking face portion 802 of the golf club head 800 shown in FIG. 8. In this enlarged cross-sectional view, only the features that differentiate this embodiment of the present invention from prior embodiments have been highlighted. In this alternative embodiment of the present invention, the height H4-*a* of the upper thickened stress reducing region 820-*a* is no longer the same as height H4-*b* of the lower thickened stress reducing region 820-*b*. In fact, the height H4-*a* of the upper thickened stress reducing region 820-*a* is reduced to address stress raisers that often arise in the upper part of the striking face portion 802. Resultingly, due to the reduction in height H4-*a* of the upper thickened stress reducing region 820-*a*, the height H3-*a* of the upper thinned intermediate region 818-*a* is increased. In addition to the above, to further reduce the stress, the radius R3-*a* between the upper thickened stress reducing region 820-*a* and the upper thinned intermediate region 818-*a* is increased to create a more gradual blend at this location. Finally, unrelated to addressing the stress levels of the striking face portion 802, the radius R5-*a* between the upper thickened stress reducing region 820-*a* and the upper thinned perimeter region 822-*a* is also increased to soften the blend to allow for case of manufacturability.

Diving into the numbers, the height H4-*a* of the upper thickened stress reducing region 820-*a* in accordance with this embodiment of the present invention, may generally be between about 3.1 mm to about 3.9 mm, more preferably between about 3.3 mm top about 3.7 mm, and most preferably about 3.5 mm, which is about 0.5 mm shorter than its counter part H4-*b* located at the lower thickened stress reducing region 820-*b*. The height H3-*a* of the upper thinned intermediate region 818-*a* in accordance with this current embodiment of the present invention, may generally be between about 6.5 mm to about 8.5 mm, more preferably between about 7.0 mm to about 8.0 mm, and most preferably about 7.5 mm, which makes it approximately the same as it's counter part H3-*b* located at the lower thinned intermediate region 818-*b*.

In addition to changes in the height, the radius R3-*a* and R5-*a* of the upper thickened stress reducing region 820-*a* have also been altered to be different from its counter part at the lower thickened stress reducing region 820-*b*. By increasing the radius of curvature of R3-*a*, the more gradual transition between the two neighboring components help eliminate stress risers that could occur at that portion of the striking face portion 802. The R3-*a* in accordance with this embodiment of the present invention may generally be greater than about 1.50 mm, more preferably greater than about 1.60 mm, and more preferably greater than about 1.70 mm. The radius of curvature R5-*a* on the other hand, is also increased to be more gradual, but this time for manufacturing reasons allowing for a less pronounced region of reduced casting flow. Thus R5-*a* in accordance with this embodiment of the present invention may generally be greater than about 1.50 mm, more preferably greater than about 1.60 mm, and more preferably greater than about 1.70 mm. Hence it is worth noting here that in this embodiment, it is critical that the radius of curvature of the transition of the upper thickened stress reducing region 820-*a* be greater than a radius of curvature of the transition of the lower thickened stress reducing region 820-*b*, as the striking face portion 802 often exhibits higher stress levels at that location.

Figure 10A:
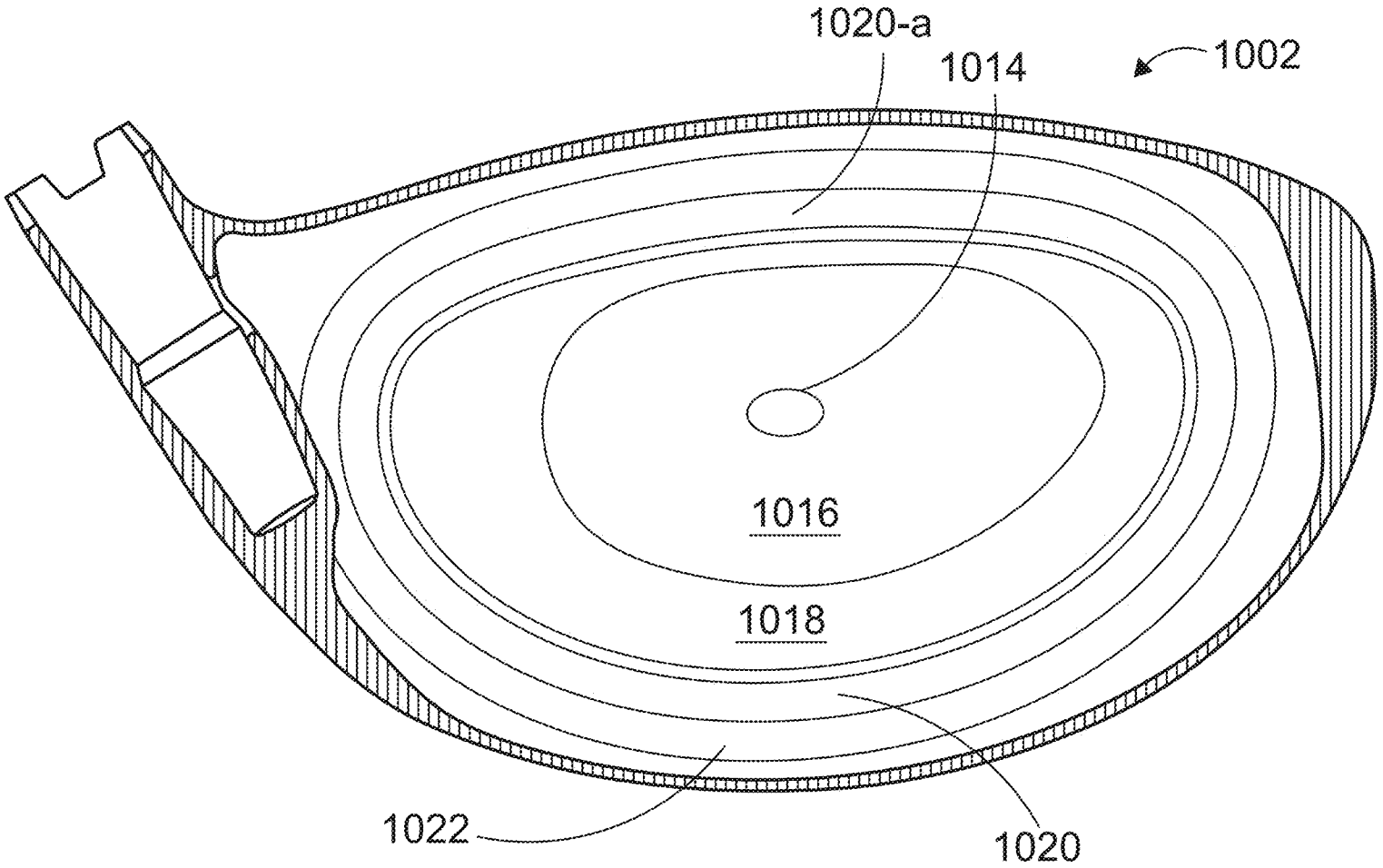
FIG. 10*a* of the accompanying drawings shows a rear shaded view of a striking face portion of a golf club head in accordance with an alternative embodiment of the present invention.
Figure 10B:
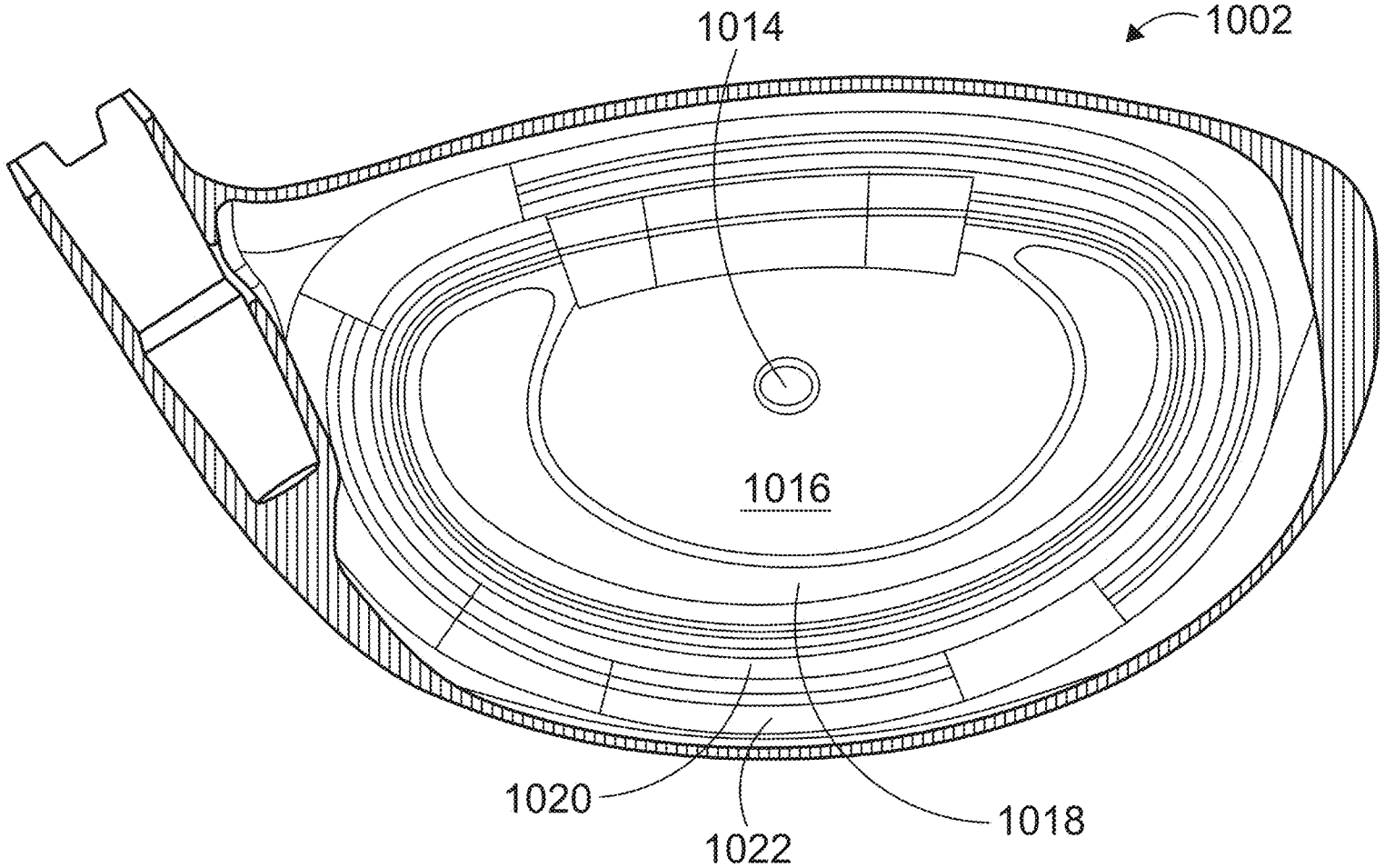
FIG. 10*b* of the accompanying drawings shows a rear view of a striking face portion of a golf club head in accordance with an alternative embodiment of the present invention.

FIGS. 10*a* and 10*b* show a rear view of the striking face portion 1002 of a golf club head in accordance with an exemplary embodiment of the present invention. In FIG. 10*a*, a shaded view is presented to provide a better visual of the various components of the striking face portion 1002. In this shaded view shown in FIG. 10*a* and the wireframe view shown in FIG. 10*b*, the adjustments to the upper thickened stress reducing region 1020-*a* can be seen, and its height H4-*a* (shown in FIG. 9) is smaller when compared to the remaining portions of the thickened stress reducing region 1020-*a*. Another thing worth noting here that was previously not mentioned is that in the current exemplary embodiment of the present invention, the entire thickened stress reducing region 1020 takes on the shape of a ring encircles the central portion of the striking face portion 1002. However, in alternative embodiments of the present invention, the thickened stress reducing region 1020 may not need to encircle the striking face portion 1002 completely and can partially surround the striking face portion without departing from the scope and content of the present invention. Alternatively speaking, the thickened stress reducing region 1020 may only encircle less than 360 degrees around the face, less than about 270 degrees around the face, less than 180 degrees around the face, all without departing from the scope and content of the present invention.

FIGS. 11 through 15 of the accompanying drawings shows a golf club head in accordance with a further alternative embodiments of the present invention, wherein the thickened stress reducing region is formed out of multiple materials to achieve the further improve upon the stress reducing capabilities of the thickened stress reducing region.

Figure 11:
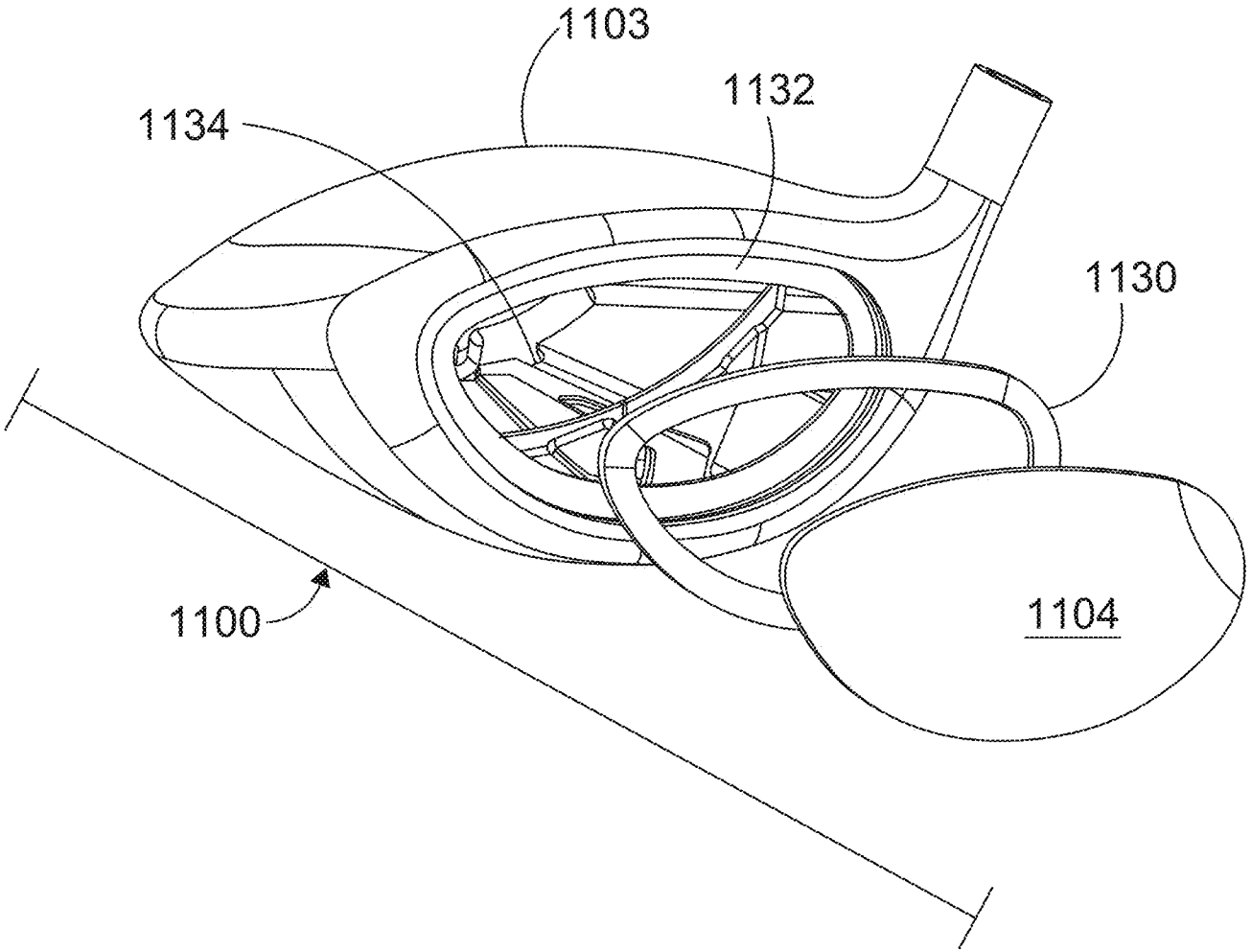
FIG. 11 of the accompanying drawings shows an exploded view of a golf club head in accordance with an even further alternative embodiment of the present invention.

FIG. 11 of the accompanying drawings shows an exploded perspective view of a golf club head 1100 in accordance with a further alternative embodiment of the present invention, wherein the thickened stress reducing region is further formed out of multiple materials. In this exploded cross-sectional view of the golf club head 1100 shown in FIG. 11, the body portion 1103 has a pocket 1134 with a perimeter ledge 1132, wherein the perimeter ledge 1132 helps receive a gasket 1130 and the gasket 1130 separates the face insert 1104 from the perimeter ledge 1132. The combination of the perimeter ledge 1132, the gasket 1130, and the perimeter of the face insert 1104 combine to create the thickened stress reducing region (shown in FIG. 12) in this embodiment of the present invention.

Figure 12:
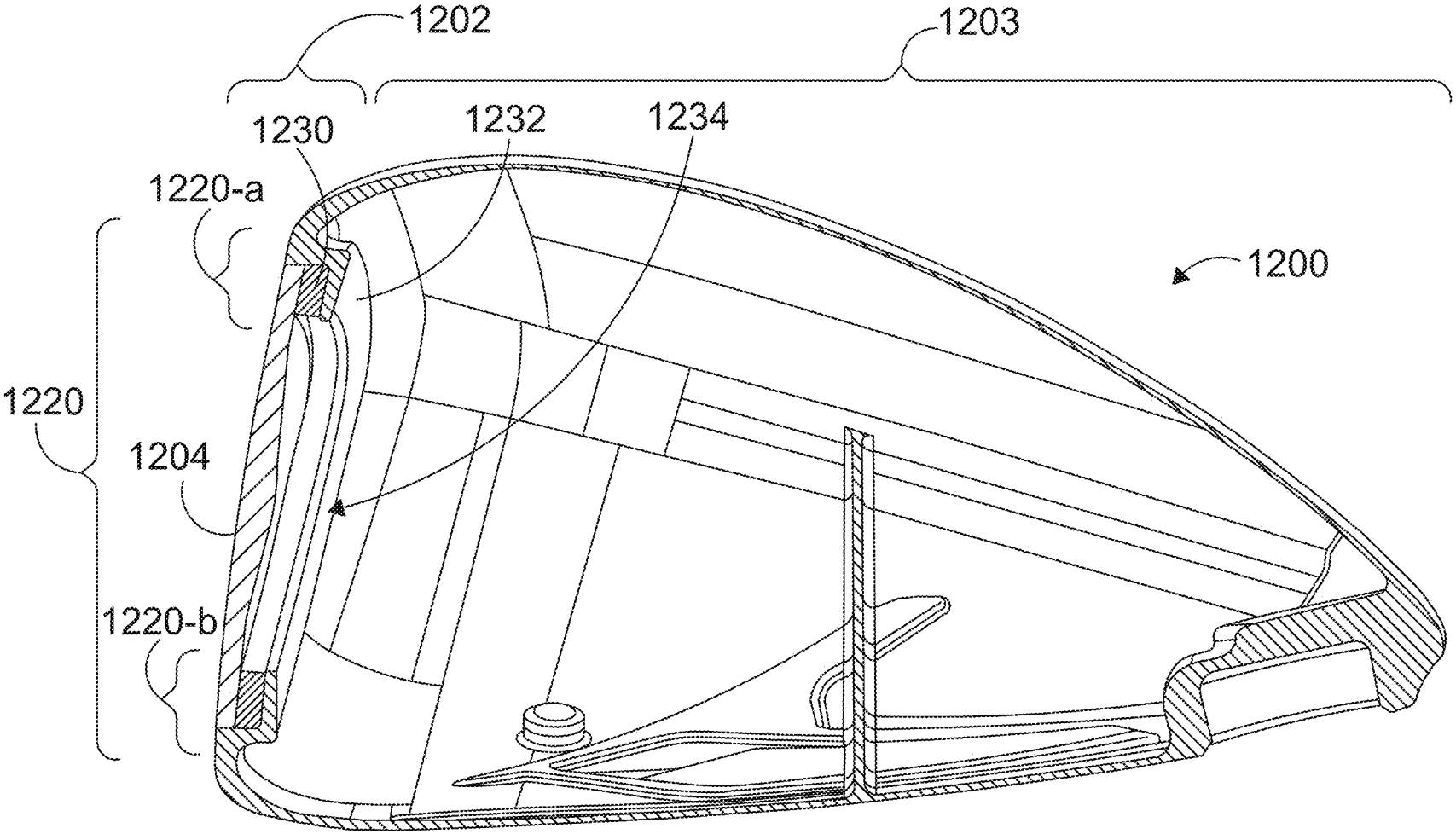
FIG. 12 of the accompanying drawings shows a cross-sectional view of a golf club head in accordance with the even further alternative embodiment of the present invention.

FIG. 12 of the accompanying drawings shows a cross-sectional view of a golf club head 1200 in accordance with an alternative embodiment of the present invention, taken along cross-sectional line A-A' shown in FIG. 1. In this cross-sectional view of the golf club head 1200, we can see that the golf club head 1200, similar to previous embodiments, can be split into a frontal striking face portion 1202 and a rear body portion 1203. The frontal striking face portion 1202 is further comprised out of an opening pocket 1234 adapted to receive a face insert 1204 like previous embodiments. However, in this embodiment of the present invention, instead of having the face insert 1204 being welded directly onto the perimeter of the opening pocket 1234 as it is commonly known in the industry, the opening pocket 1234 creates a perimeter ledge 1232 that is recessed from the external plane of the striking face, and the perimeter ledge 1232 is adapted to receive a gasket 1230 that separates the face insert 1204 from the perimeter ledge 1232. In this cross-sectional view of the present invention, we can clearly see that the combination of the perimeter ledge 1232, the gasket 1230, and the perimeter of the face insert 1204 combine to create the thickened stress reducing region 1220. The thickened stress reducing region 1220 in this embodiment may further be defined as an upper thickened stress reducing region 1220-*a* and a lower thickened stress reducing region 1220-*b*, both of which have dimensional measurements similar to previous embodiments described previously.

In this embodiment of the present invention, the face insert 1204, gasket 1230, and perimeter ledge 1232 may generally be bonded together using some type of a glue adhesive. However, in alternative embodiments of the present invention, the three components that form the thickened stress reducing region 1220 that may have different material properties, may also rely on alternate bonding techniques such as brazing, swaging, or even mechanical fastening all without departing from the scope and content of the present invention so long as the face insert 1204 is not directly bonded to the perimeter ledge 1232 itself.

The material used to create the gasket 1230 is also critical in this embodiment of the present invention, as may help reduce stress around the perimeter of the frontal striking face portion 1202. In this embodiment, the material used to create the gasket may generally have a modulus of elasticity, or Young's modulus of between about 5 GPa and about 120 GPa, more preferably between about 10 GPa and about 80 GPa, and most preferably about 30 GPa. In addition to the above, the gasket 1230 may also have density of less than about 2,000 g/cc, more preferably less than about 1,900 g/cc, and most preferably less than about 1,800 g/cc, all without departing from the scope and content of the present invention.

Figure 13:
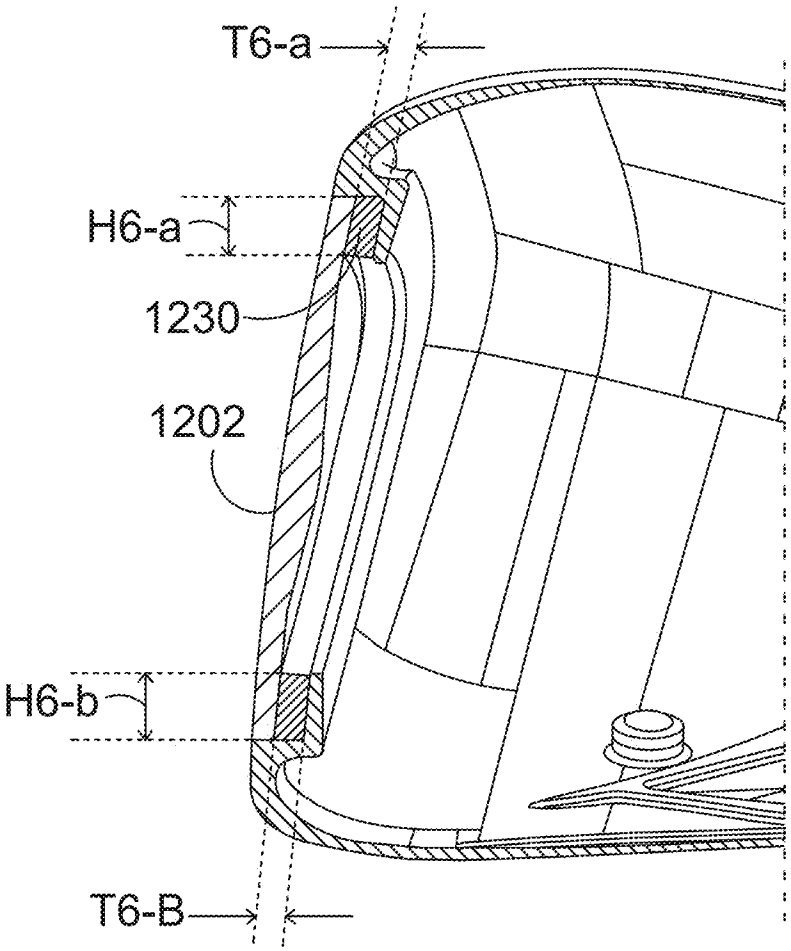
FIG. 13 of the accompanying drawings shows a partial-cross-sectional view of a striking face portion of a golf club head in accordance with an even further alternative embodiment of the present invention.

In order to illustrate some of the dimensions of the gasket 1230 itself, an enlarged cross-sectional view of the frontal striking face portion 1202 is provided in FIG. 13. In this view shown in FIG. 13, we can see that the gasket 1230 may have an upper gasket height H6-*a* and a lower gasket height H6-*b* that are approximately the same. H6-*a* and H6-*b* in accordance with this embodiment of the present invention may generally be between about 3.0 mm to about 7.0 mm, more preferably between about 4.0 mm to about 6.0 mm, and most preferably about 5.0 mm. FIG. 13 also shows the thickness T6 of the gasket, illustrated as an upper gasket thickness T6-*a* and a lower gasket thickness T6-*b*, both of which are approximately the same in this embodiment of the present invention. Hence, T6-*a* and T6-*b* in accordance with this embodiment of the present invention may generally be between about 0.3 mm to about 0.7 mm, more preferably between about 0.4 mm to about 0.6 mm, and most preferably about 0.5 mm.

Based on the thickness and height measurements above, it can be said that the gasket 1230 may have a T over H Ratio defined by Equation (2) below:

$$T \text{ over } H \text{ Ratio} = \frac{\text{Thickness } T6 \text{ of Gasket}}{\text{Height } T6 \text{ of Gasket}} \qquad \text{Eq. (2)}$$

The T over H Ratio of the gasket 1230 may generally be between about 0.04 and about 0.23, more preferably between about 0.06 to about 0.15, and most preferably about 0.1.

It should also be noted that although the thickness and height of the gasket 1230 is the same for the upper portion of the gasket 1230 and the lower portion of the gasket 1230, the thickness and height of the gasket could be different from one another without departing from the scope and content of the present invention. In one exemplary embodiment, the upper portion of the gasket 1230 could be thicker while the lower portion of the gasket 1230 could be thinner, to help the striking face portion 1202 deflect more downward upon impact with a golf ball to reduce lower launch and spin without departing from the scope and content of the present invention. Needless to say, if the thickness of the gasket 1230 are to be manipulated, the depth of the perimeter ledge 1232 is generally adjusted accordingly to create a seamless flush look of the golf club head in its resting neutral position. Alternatively, the thickness of the material could be maintained, but the modulus adjusted to achieve the same effects without departing from the scope and content of the present invention.

Figure 14:
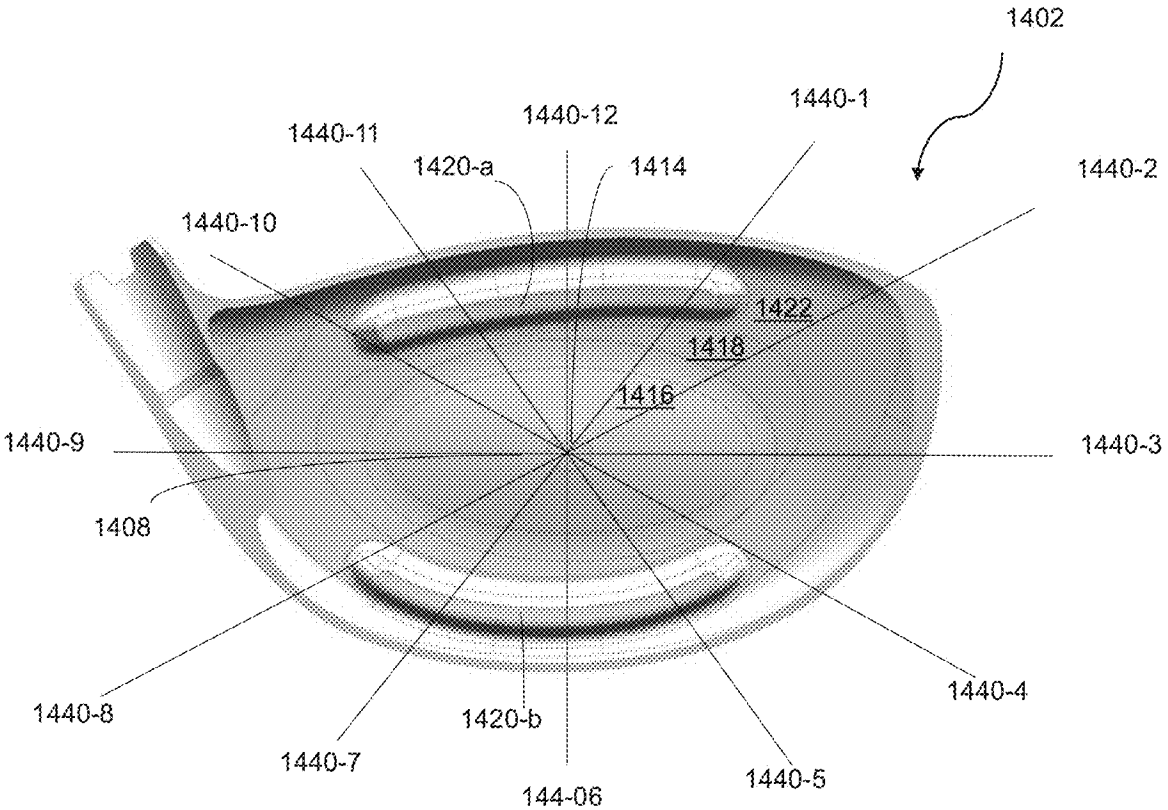
FIG. 14 of the accompanying drawings shows a rear view of a striking face portion of a golf club head in accordance with a further alternative embodiment of the present invention.

FIG. 14 of the accompanying drawing shows a rear view of a striking face portion 1402 of a golf club head in accordance with a further alternative embodiment of the present invention. In this embodiment of the present invention shown in FIG. 14, we can see that the frontal striking face portion 1402 may have a thickened stress reducing region 1420 that only partially forms a portion of the ring as shown in previous embodiments. More specifically, the thickened stress reducing region 1420 shown in this embodiment of the present invention shown in FIG. 14 only exists in the upper crown region and the lower sole region via the upper thickened stress reducing region 1420-*a* and the lower thickened stress reducing region 1420-*b*.

The rear view of the striking face portion 1402 shown here in FIG. 14 illustrates the thickened central region 1414, the central transition region 1416, the thinned intermediate region 1418, and the thinned perimeter region 1422, in addition to the upper thickened stress reducing region 1420-*a* and the lower thickened stress reducing region 1420-*b*. This rear view of the striking face portion 1402 shows that the upper thickened stress reducing region 1420-*a* and the lower thickened stress reducing region 1420-*b* combining with one another to form only a portion of a ring geometry as shown previously in FIG. 7. Alternatively speaking, it can be said that the thickened stress reducing region 1420 only partially surrounds the thinned intermediate region 1418 instead of fully surrounding it. It can also be said that the thickened stress reducing region forms at less than 360 degrees radially around the perimeter of the thinned intermediate region 1418.

In addition to highlighting the now split upper thickened stress reducing region 1420-*a* and the lower thickened stress reducing region 1420-*b* visually, FIG. 14 of the accompanying drawings also creates a clock grid 1440 to more specifically identify the locations of the upper thickened stress reducing region 1420-*a* and the lower thickened stress reducing region 1420-*b* relative to the geometric face center 1408. More specifically, the clock grid 1440 has a 12 o'clock ray 1440-12, a 1 o'clock ray 1440-1, a 2 o'clock ray 1440-2, a 3 o'clock ray 1440-3, a 4 o'clock ray 1440-4, a 5 o'clock ray 1440-5, a 6 o'clock ray 1440-6, a 7 o'clock ray 1440-7, an 8 o'clock ray 1440-8, a 9 o'clock ray 1440-9, a 10 o'clock ray 1440-10, and an 11 o'clock ray 1440-11; dividing the various portions of the striking face portion 1402 into twelve separate regions radially.

Once the clock grid 1440 is established, we can see that in this exemplary embodiment of the present invention the upper thickened stress reducing region 1420-*a* is positioned at an upper region located between the 10 o'clock ray 1440-10 and the 2 o'clock ray 1440-2. The lower thickened stress reducing region 1420-*b* is positioned at a lower region located between the 4 o'clock ray 1440-4 and the 8 o'clock ray 1440-8. This range of location for the upper thickened stress reducing region 1420-*a* and the lower thickened stress reducing region 1420-*b* is critical to the present invention because it preserves the structural rigidity and reduces the stress levels of the striking face portion 1402 only at locations that have been identified to need it and eliminates it from locations that do not need such a feature.

Please note here that the boundaries of the clock grid is always referenced in a clockwise direction, as to avoid confusion when referencing the ranges in this application.

Alternatively speaking, it can be said that the thickened stress reducing region is located only at a region consisting of an upper region between the 10 o'clock ray 1440-10 and the 2 o'clock ray 1440-2 and a lower region between the 4 o'clock ray 1440-4 and the 8 o'clock ray 1440-8.

Figure 15:
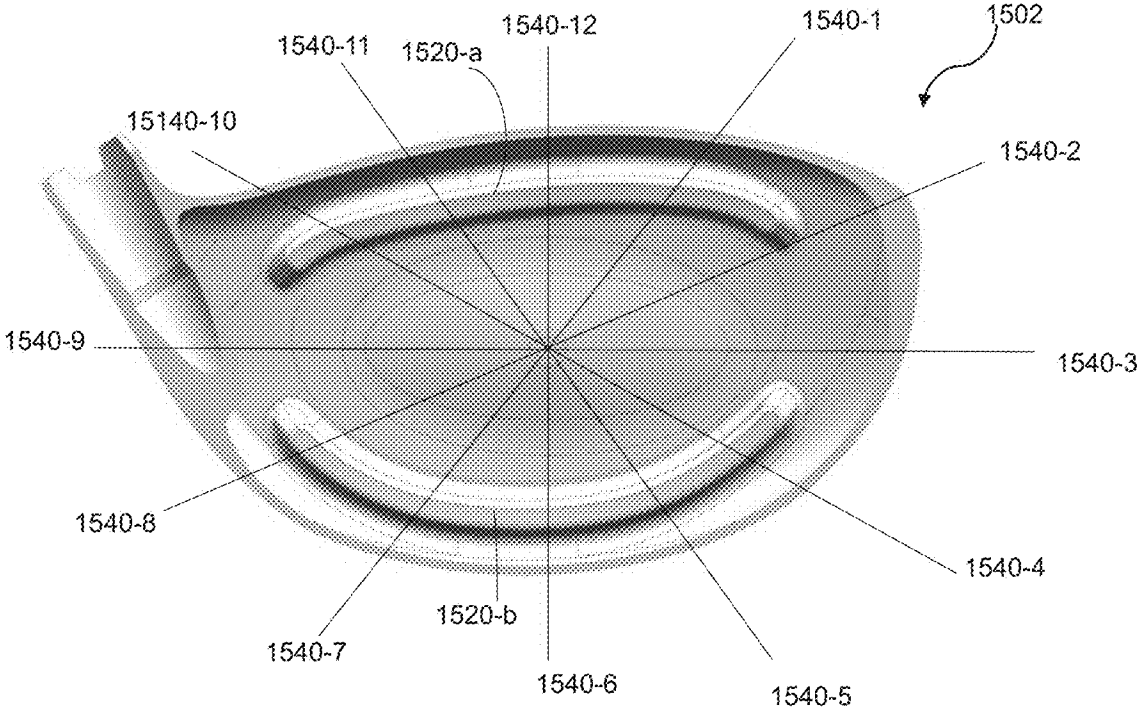
FIG. 15 of the accompanying drawings shows a rear view of a striking face portion of a golf club head in accordance with a further alternative embodiment of the present invention.

FIG. 15 of the accompanying drawings shows a rear view of a striking face portion 1502 of a golf club head in accordance with a further alternative embodiment of the present invention. In this embodiment of the present invention, the upper thickened stress reducing region 1520-*a* is located at an upper region between the 9 o'clock ray 1540-9 and the 2 o'clock ray while the lower thickened stress reducing region 1520-*b* is located at a lower region between the 3 o'clock ray 1540-3 and the 9 o'clock ray 1540-9 without departing from the scope and content of the present invention. It should be noted here that the boundaries of the upper thickened stress reducing region 1520-*a* and the lower thickened stress reducing region 1520-*b* may have some overlap with one another, they are discrete components with separation to stay within the scope and content of the present invention.

Alternatively speaking, it can be said that the thickened stress reducing region is located only at a region consisting of an upper region between the 9 o'clock ray 1540-9 and the 2 o'clock ray 1540-2 and a lower region between the 3 o'clock ray 1540-3 and the 9 o'clock ray 1540-9.

Figure 16:
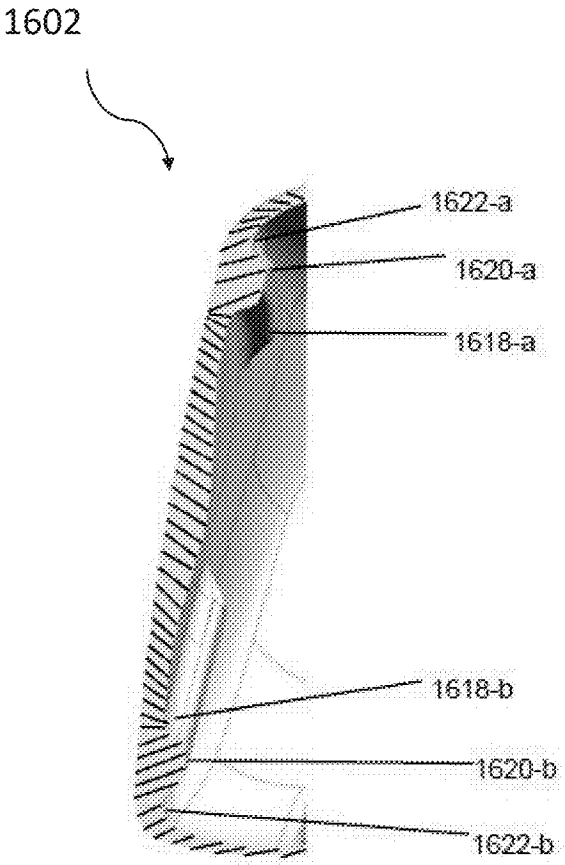
FIG. 16 of the accompanying drawings shows an enlarged cross-sectional view of a striking face portion in accordance with an alternative embodiment of the present invention.

FIG. 16 of the accompanying drawings shows an enlarged cross-sectional view of a striking face portion 1602 in accordance with an alternative embodiment of the present invention, allowing the non-360 degree thickened stress reducing region 1620 to be shown in more detail. In this view, we can see that the actual cross-sectional view of the striking face portion 1602 containing an upper thinned intermediate region 1618-*a*, a lower thinned intermediate region 1618-*b*, an upper thickened stress reducing region 1620-*a*, a lower thickened stress reducing region 1620-*b*, an upper thinned perimeter region 1622-*a*, and a lower thinned perimeter region 1622-*b* does not look much different than the cross-sectional views of the striking face portion 802 shown in previous embodiments of the present invention in FIG. 9. However, a closer examination of the cross-sectional view of the striking face portion 1602 will show that an internal toe region of the striking face portion 1602 does not contain any feature that resembles a thickened stress reducing region 1620, like the previous embodiments shown in FIGS. 14 and 15.

Figure 17:
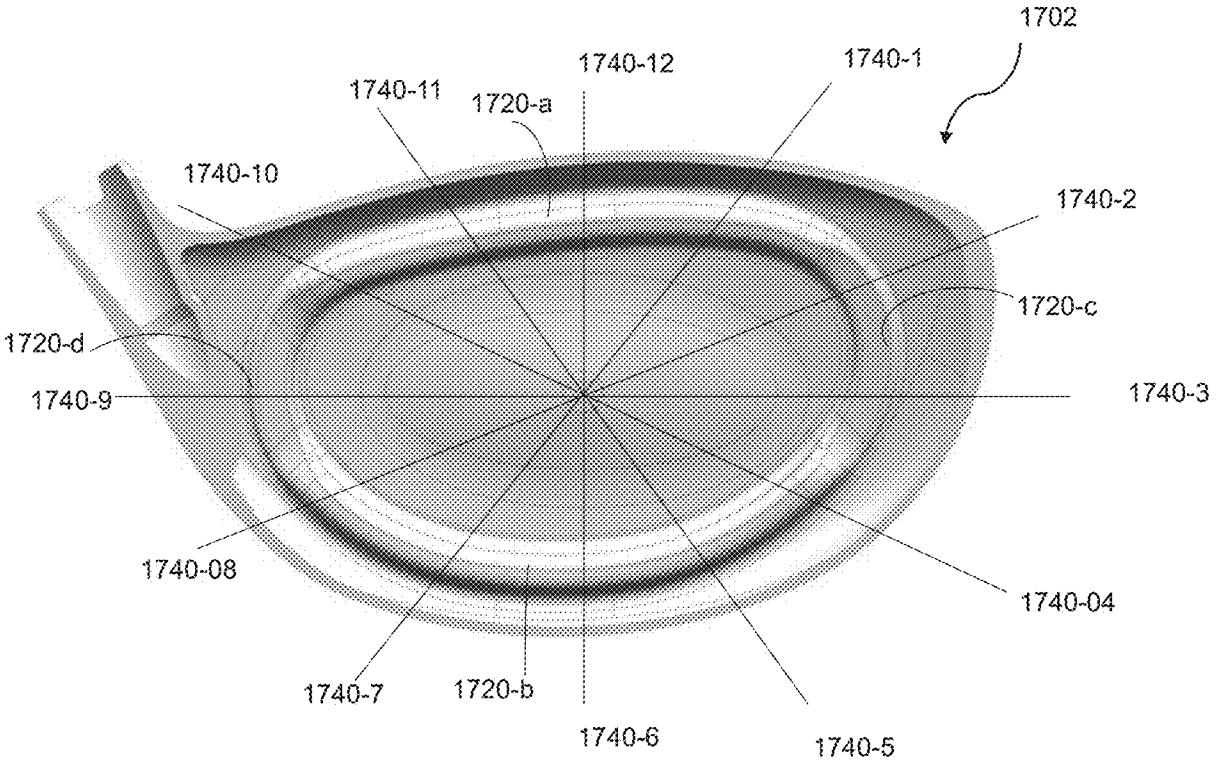
FIG. 17 of the accompanying drawings shows a rear view of a striking face portion of a golf club head in accordance with an even further alternative embodiment of the present invention.

FIG. 17 of the accompanying drawings shows a rear view of a striking face portion 1702 of a golf club head in accordance with a further alternative embodiment of the present invention. In this embodiment of the present invention, we can see the familiar clock grid 1740 having a 12 o'clock ray 1740-12, a 1 o'clock ray 1740-1, a 2 o'clock ray 1740-2, a 3 o'clock ray 1740-3, a 4 o'clock ray 1740-4, a 5 o'clock ray 1740-5, a 6 o'clock ray 1740-6, a 7 o'clock ray 1740-7, an 8 o'clock ray 1740-8, a 9 o'clock ray 1740-9, a 10 o'clock ray 1740-10, and an 11 o'clock ray 1740-11; dividing the various portions of the striking face portion 1702 into twelve separate regions radially. However, unlike previous embodiments wherein the thickened stress reducing region 1420 (shown in FIG. 14) completely disappears at the heel and toe portion of the striking face portion 1702, the thickened stress reducing region 1720 shown in FIG. 17 maintains a minimal amount of wall thickness at the heel and toe portions of the striking face portion 1702.

In this embodiment of the present invention shown in FIG. 17, it can be said that the thickened stress reducing region 1720 is one continuous feature, having an upper thickened stress reducing region 1720-*a*, a lower thickened stress reducing region 1720-*b*, a toe thickened stress reducing region 1720-*c*, and a heel thickened stress reducing region 1720-*d*, wherein the toe thickened stress reducing region 1720-*c* and the heel thickened stress reducing region 1720-*d* have a relatively smaller thickness compared to the upper thickened stress reducing region 1720-*a* and the lower thickened stress reducing region 1720-*b*.

Alternatively speaking, it can be said that in this embodiment of the present invention, the thickened stress reducing region may have an area of reduced thickness between the 1 o'clock ray 1740-1 and the 4 o'clock ray 1740-4 forming the toe thickened stress reducing region 1720-*c*, as well as an area of reduced thickness between the 8 o'clock ray 1740-8 and the 10 o'clock ray 1740-10 forming the heel thickened stress reducing region 1720-*d*.

Figure 18:
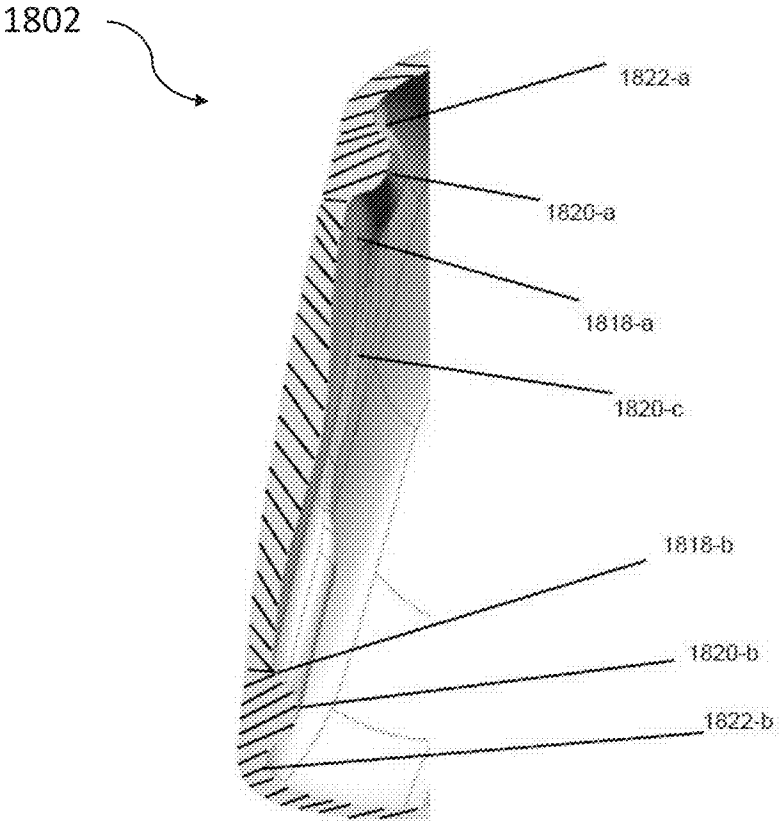
FIG. 18 of the accompanying drawings shows an enlarged cross-sectional view of a striking face portion of a golf club head in accordance with an even further alternative embodiment of the present invention.

FIG. 18 of the accompanying drawings shows an enlarged cross-sectional view of a striking face portion 1802 in accordance with an alternative embodiment of the present invention, allowing the reduced thickness thickened stress reducing region 1820 to be shown in more detail. Similar to previous embodiments, this cross-sectional view of the striking face portion 1802 contains an upper thinned intermediate region 1818-*a*, a lower thinned intermediate region 1818-*b*, an upper thickened stress reducing region 1820-*a*, a lower thickened stress reducing region 1820-*b*, an upper thinned perimeter region 1822-*a*, and a lower thinned perimeter region 1822-*b*. However, this view shown in FIG. 18 allows the reduced thickness of the toe thickened stress reducing region 1820-*c* to be shown.

Figure 19:
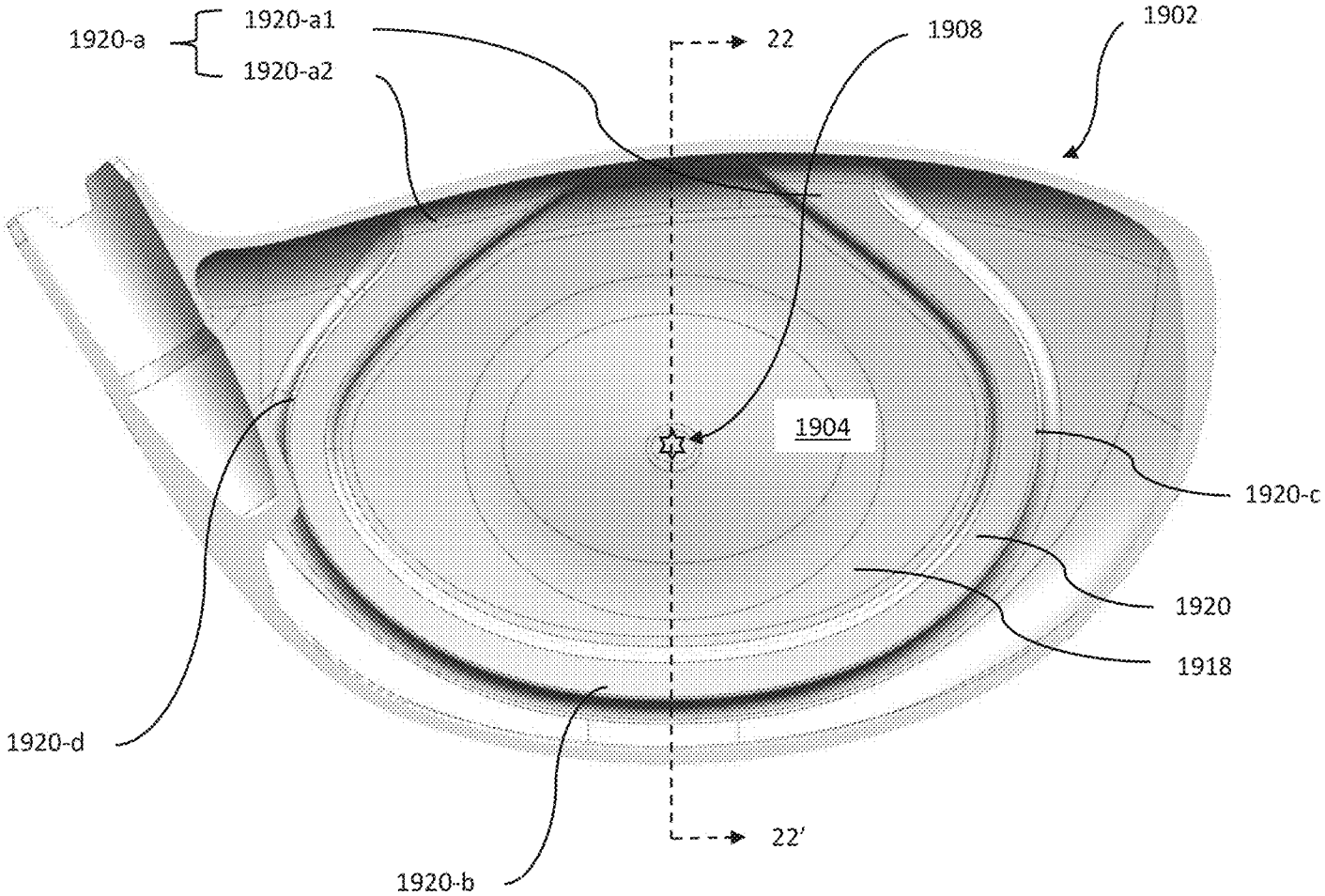
FIG. 19 of the accompanying drawings shows a rear view of a striking face portion of a golf club head in accordance with a further alternative embodiment of the present invention.

FIG. 19 of the accompanying drawings shows a rear view of a striking face portion 1902 of a golf club head in accordance with a further alternative embodiment of the present invention. In this embodiment of the present invention, the thickened stress reducing region 1920 that extends outward radially from said thinned intermediate region 1918. However, in this embodiment of the present invention, the thickened stress reducing region 1920 has a horseshoe shape instead of a ring shape to help accommodate a different shaped face insert 1904 capable of improving the performance of the striking face portion 1902. More specifically, it can be seen in FIG. 19 that the thickened stress reducing region 1920 may have two upper stress reducing region 1920*a*, designated as a toe side upper thickened stress reducing region 1920-*a*1 and a heel side upper thickened stress reducing region 1920-*a*2. It should be noted that both the toe side upper thickened stress reducing region 1920-*a*1 and the heel side upper thickened stress reducing region 1920-*a*2 connects directly to the crown transition portion of the striking face portion 1902, meaning that they do not directly connect with one another at the crown portion of the striking face portion 1902 to form a complete ring, rather it creates a discontinuity that forms an incomplete circle. Alternatively, it can be said that the thickened stress reducing region 1920 forms the horseshoe shaped described above. Consequently, the horseshoe shaped thickened stress reducing region 1920 creates an opening near an upper crown portion of the striking face portion 1902.

The toe side upper thickened stress reducing region 1920-*a*1 here connects to the toe side thickened stress reducing region 1920-*c* on the toe side of the striking face portion 1902, which in turn connects to the lower thickened stress reducing region 1920-*b* on the sole side of the striking face portion 1902, which in turn connects to the heel side thickened stress reducing region 1920-*d*, but remains disconnected at the upper crown region of the striking face portion 1902 to accommodate a taller face insert 1904 that is designed to be taller at the central region of the face insert 1904 to help remove the weld line between the face insert 1904 and the perimeter region 1903 (shown in FIG. 20) further away from a location that generates high stresses in this current design. In order to further illustrate the shape of the perimeter region 1903 and the central opening 2050 (shown in FIG. 20), FIG. 20 is provided with the face insert 1904 removed.

Figure 20:
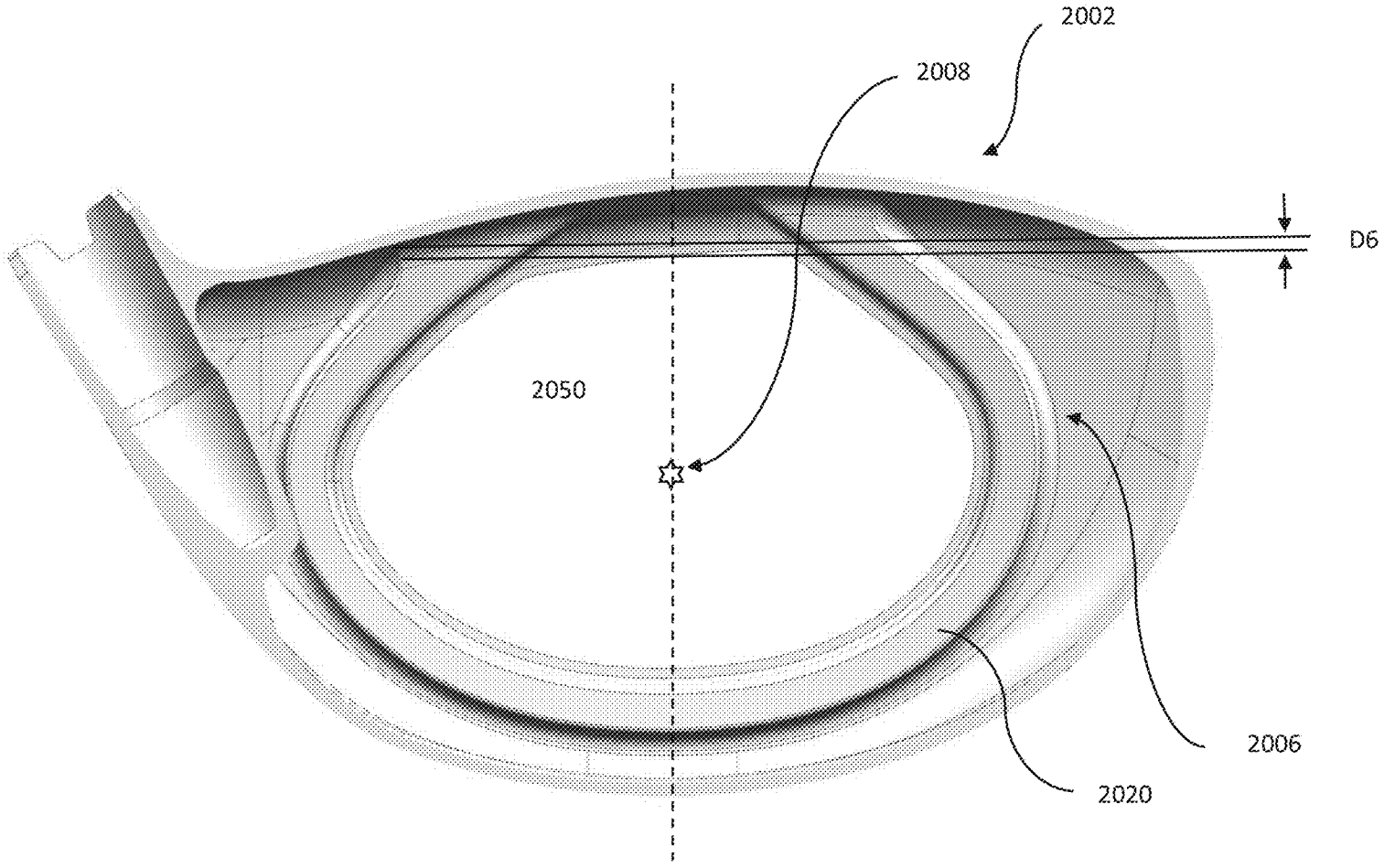
FIG. 20 of the accompanying drawings shows a rear view of a striking face portion of a golf club head with the face insert removed in accordance with a further alternative embodiment of the present invention.

Finally, it can be seen here in FIG. 20 that a cross-sectional line 22-22' is drawn vertically through the striking face portion 1902 passing through the geometric face center 1908 of the striking face portion 1902. The cross-sectional view of the striking face portion 1902 of the golf club head shown later FIG. 22 allows the various dimensions of the striking face portion 1902 to be shown in more detail later.

FIG. 20 of the accompanying drawings shows a rear view of a striking face portion 2002 of a golf club head in accordance with a further alternative embodiment of the present invention, but with the face insert 1904 (shown in FIG. 19) removed, allowing the central opening 2050 to be shown more clearly together with the boundaries of the face perimeter 2006. The striking face portion 2002 shown here in FIG. 20, in order to pair with the horseshoe shaped thickened stress reducing region 2020, has a central opening 2050 that substantially matches the internal circumference of the horseshoe shaped thickened stress reducing region 2020. In addition to showing the boundaries of the central opening 2050, FIG. 20 of the accompanying drawings also shows a distance between a top ledge of the central opening 2050 to the crown leading edge of the striking face portion 2002, as indicated by distance D6 shown here. Distance D6 shown in FIG. 20 illustrates how that distance is reduced compared to a prior art golf club head, and may generally be less than about 1.25 mm, more preferably less than about 1.00 mm, and most preferably less than about 0.95 mm. The distance D6 as shown in this embodiment of the present invention is generally taken as the y-axis shown in FIG. 1, taken at the geometric center 2008 of the face, illustrated by the broken line shown in FIG. 20.

Figure 21:
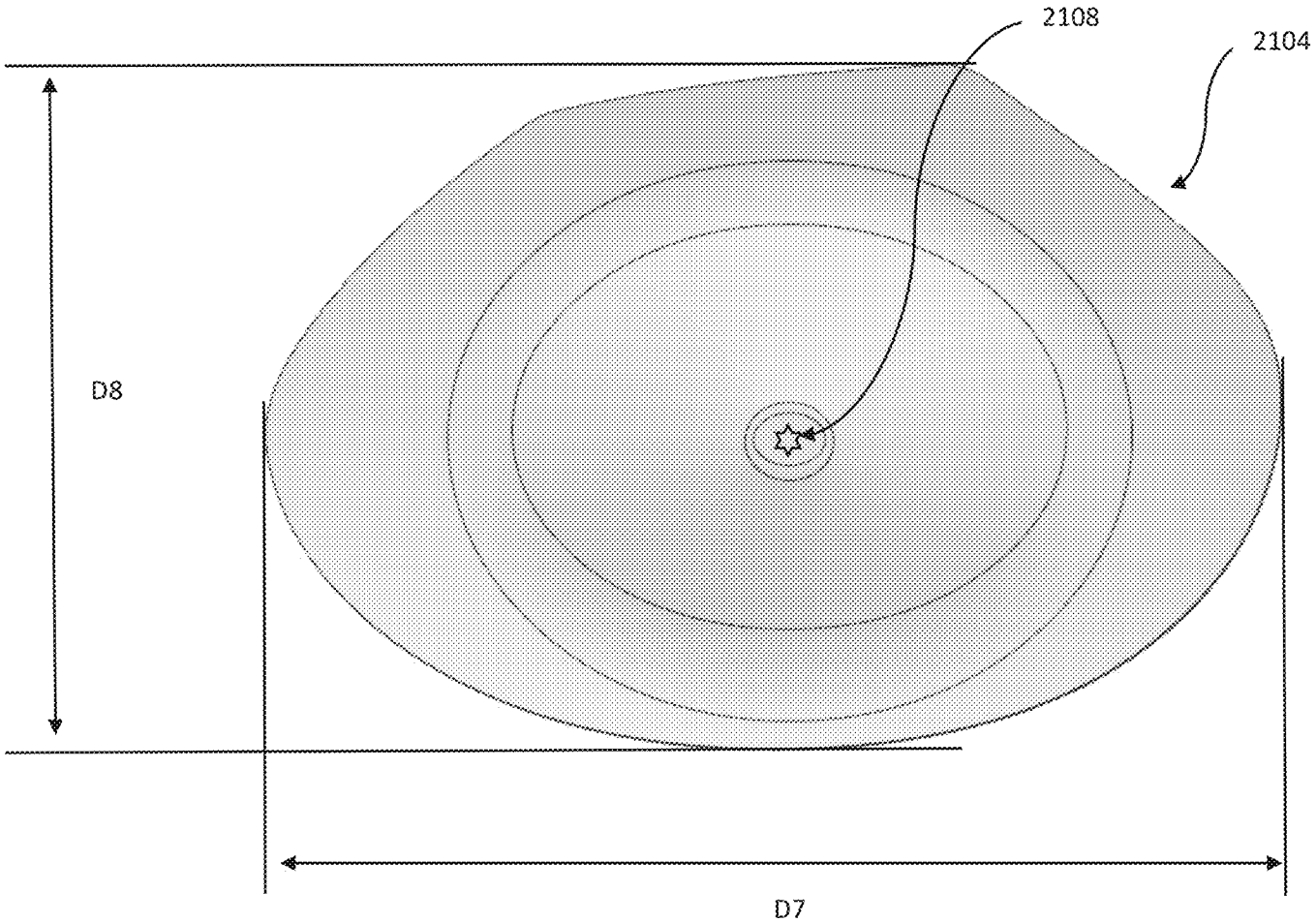
FIG. 21 of the accompanying drawings shows an enlarged rear view of a face insert in accordance with a further alternative embodiment of the present invention.

Traditionally shaped face inserts 104 (shown in FIG. 1) may generally have a substantially oval shape designed to match the outline of the striking face portion 102 (shown in FIG. 1) having an aspect ratio of about 2.0. However, the face insert 2104 in accordance with this present embodiment of the present invention, due it's taller face, may have an aspect ratio between about 1.3 to about 1.7, more preferably between about 1.4 to about 1.6, and most preferably about 1.5. FIG. 21 of the accompanying drawings shows a rear view of just the face insert 2102 in accordance with this alternative embodiment of the present invention. The aspect ratio of the face insert 2104 may generally be defined as the ratio of the width D7 of the face insert 2104 divided by the height D8 of the face insert 2104. In this one exemplary embodiment of the present invention, the width D7 of the face insert 2104 may generally be between about 60 mm to about 64 mm, more preferably between about 61 mm to about 63 mm, and most preferably about 62 mm. The height D8 of the face insert 2104 may generally be between about 40 mm to about 44 mm, more preferably between about 41 mm to about 43 mm, and most preferably about 42 mm. Needless to say, because the central opening 2050 (Shown in FIG. 20)

Alternatively speaking, it can be said that the striking face portion 1902 can be located at a frontal portion of the golf club head that is adapted to impact a golf ball and a body portion that is attached to the rear of the striking face portion 1902. The striking face portion 1902 has a face perimeter 2006 that has a central opening 2050 wherein the face perimeter 2006 has a horseshoe shaped thickened stress reducing region 2020 having a fourth thickness. The striking face portion 1902 further comprises a face insert 2104 adapted to engage the central opening 2050, wherein the face insert 2104 has a thickened central region located near a geometric center 2108 of the face insert 2104 that defines a first thickness. The thickened stress reducing region 2020 within the face perimeter 2006 of the striking face portion 1902 is formed in a way such that no part of the thickened stress reducing region 2020 engages the face insert 2104. The fourth thickness of the thickened stress reducing region 2020 in accordance with a preferred embodiment of the present invention is greater than a first thickness of the central region of the face insert 2104.

Figure 22:
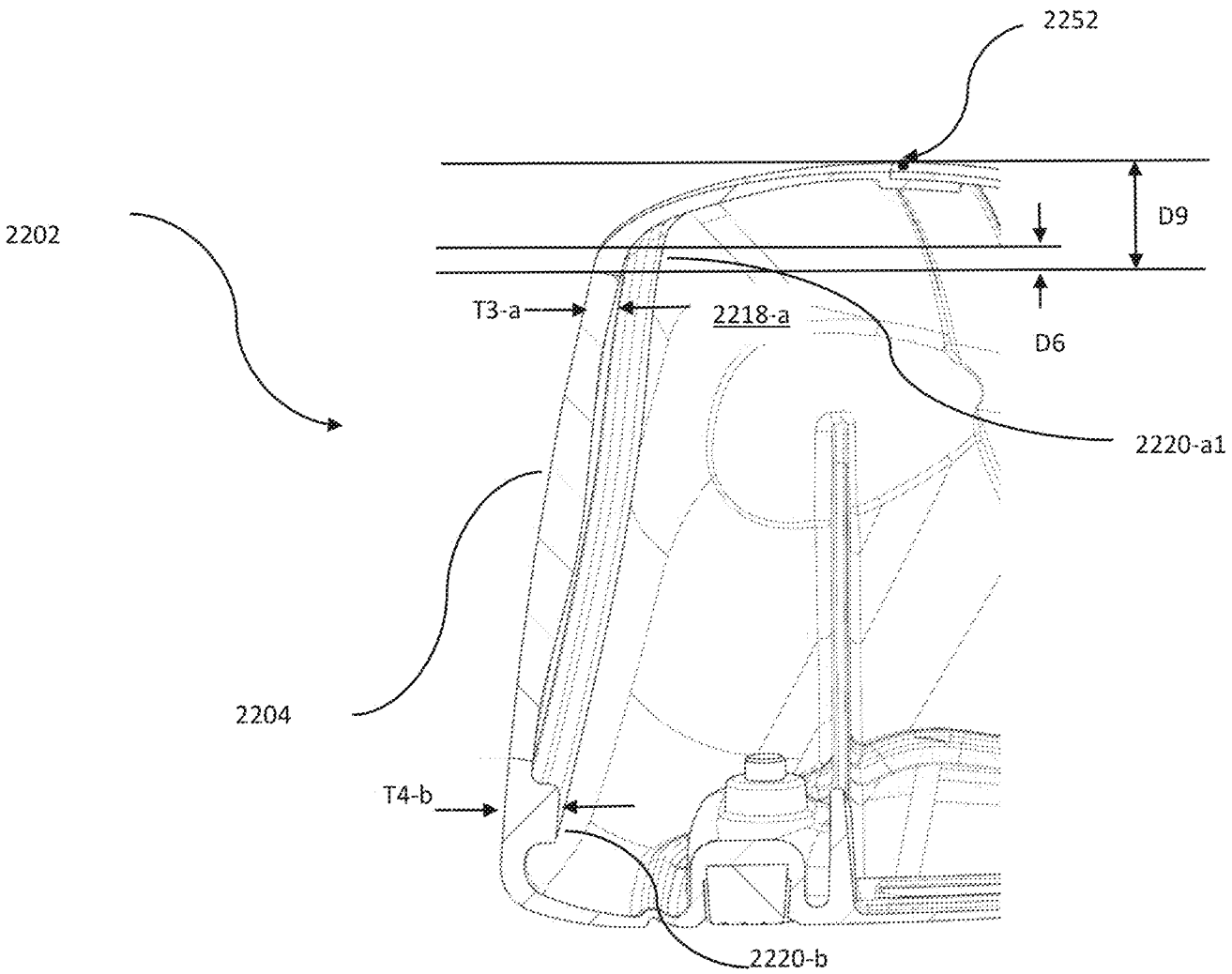
FIG. 22 of the accompanying drawings shows an enlarged cross-sectional view of a striking face portion in accordance with a further alternative embodiment of the present invention taken along cross-sectional line 22-22' in FIG. 19.

FIG. 22 of the accompanying drawings shows an enlarged cross-sectional view of a striking face portion 2202 of a golf club head taken along cross-sectional line 22-22' shown in FIG. 19. In this cross-sectional view of the striking face portion 2202, we can see that the face insert 2204 is located at a distance D6 away from the crown leading edge of the striking face portion 2202. The crown leading edge, as defined in the present invention, is the location of the striking face portion 2202 that begins to stop being substantially planar with the striking face plane, and begins transitioning into the crown. The values for distance D6 has already been discussed above, thus won't need to be repeated here. In addition to distance D6, FIG. 22 of the accompanying drawings also shows a distance D9, which measures the location of the top edge of the face insert 2204 as measured from a crown apex point 2252. The crown apex point 2252 is generally defined as the highest point of the crown, occurring at the central cross-sectional plane 22-22' shown in FIG. 19. Distance D9 as shown in this exemplary embodiment of the present invention, may generally be less than about 10 mm, more preferably less than about 9 mm, and most preferably less than about 8 mm, all without departing from the scope and content of the present invention.

Because cross-sectional line 22-21' is located at the geometric face center 1908 (shown in FIG. 19), it is bisecting the club head at a location wherein the thickened stress reducing region 2220 is discontinuous, thus no actual thickness of the upper thickened stress reducing region can be shown in this cross-sectional view. FIG. 22 does, however, show a thickness for the lower thickened stress reducing region 2220-*b* having a thickness T4-*b* as in a similar thickness as previously discussed. On the top portion of the club head, despite not being able to se the upper thickened stress reducing region 1920-*a* (shown in FIG. 19) thickness, the toe side upper thickened stress reducing region 2220-*a*1 can be seen in the background being directly connected to the crown transition portion.

FIG. 22 of the accompanying drawings also shows a thickness of the upper thinned perimeter region 2218-*a* having a thickness T3-*a* that is different from the prior embodiments of the present invention. The increased thickness of the upper thinned perimeter region 2218-*a* is necessary to alleviate some of the higher stresses at that specific location on the striking face portion 2202 when it impacts a golf ball. Thickness T3-*a* in accordance with this alternative embodiment of the present invention may generally be between 2.3 mm to about 2.6 mm, more preferably between about 2.4 mm to about 2.5 mm, and most preferably about 2.45 mm, all without departing from the scope and content of the present invention. This location of the upper thinned perimeter region 2218-*a* may generally extend further up the striking face portion 2202 than in other embodiment wherein a thickened stress reducing region 2220 forms an entire ring.

Figure 23:
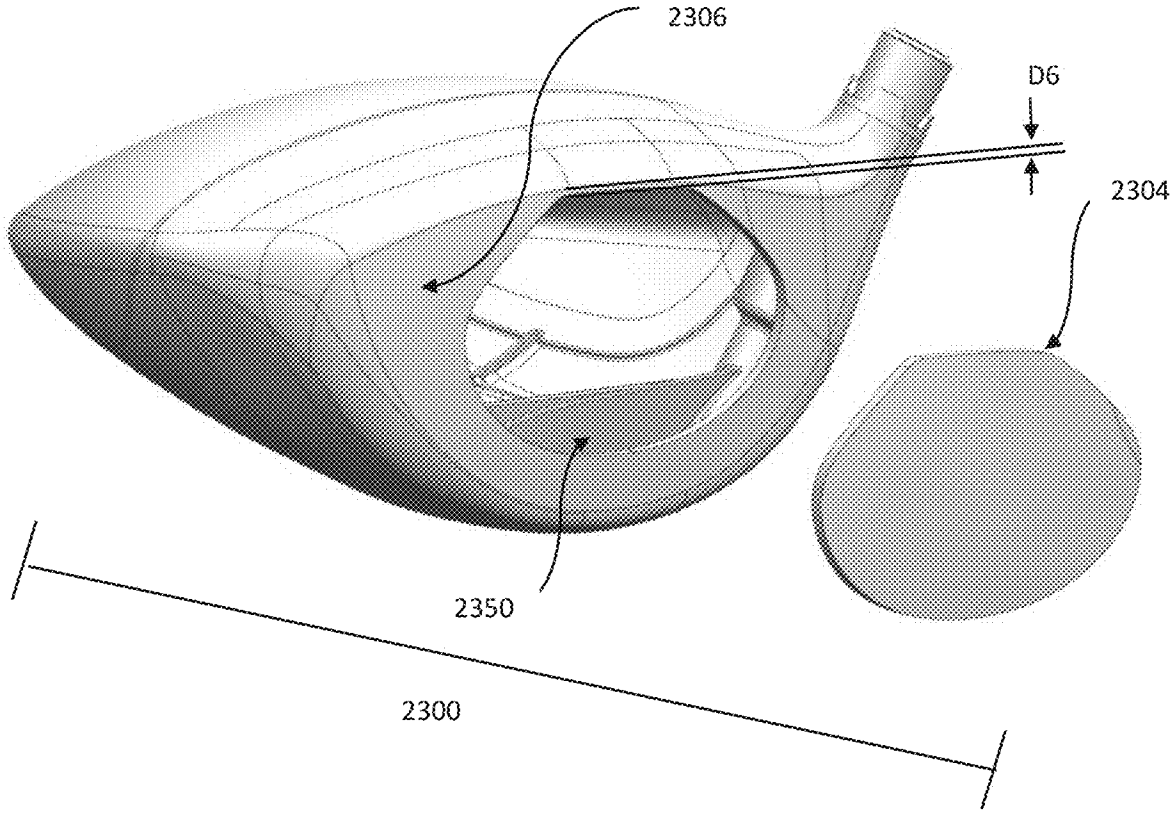
FIG. 23 of the accompanying drawings shows an exploded view of a golf club head in accordance with a further alternative embodiment of the present invention.

FIG. 23 of the accompanying drawings shows an exploded perspective view of a golf club head 2300 in accordance with this alternative embodiment of the present invention. In the exploded view shown in FIG. 23, the face insert 2304 has been moved away from the face perimeter 2306 exposing the central opening 2350, allowing the relationship between these joined components to be shown more clearly. In addition to the above, the exploded view of the golf club head 2300 shown in FIG. 23 allows the distance D6 between the top ledge of the central opening and the crown leading edge to be shown in another perspective.

Figure 24:
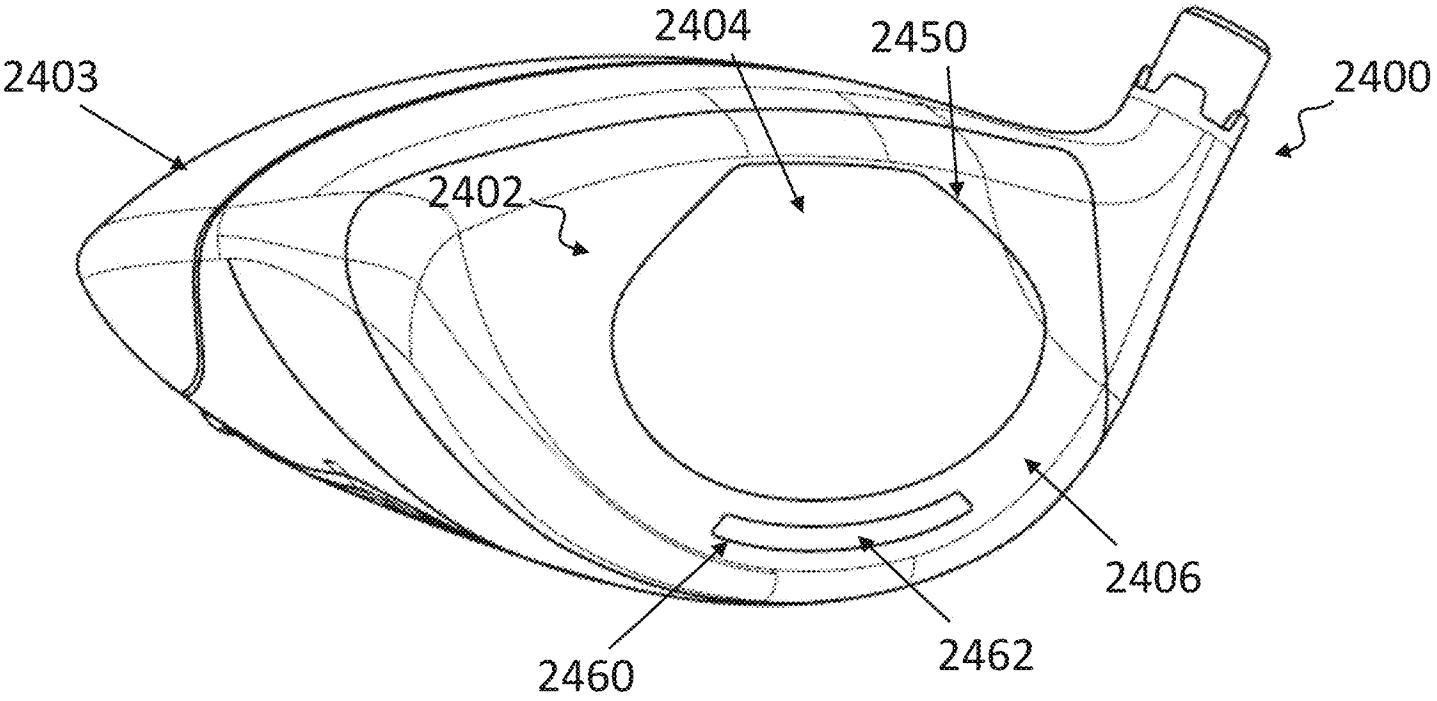
FIG. 24 of the accompanying drawings shows a perspective view of a golf club head in accordance with an embodiment of the present invention.
Figure 25:
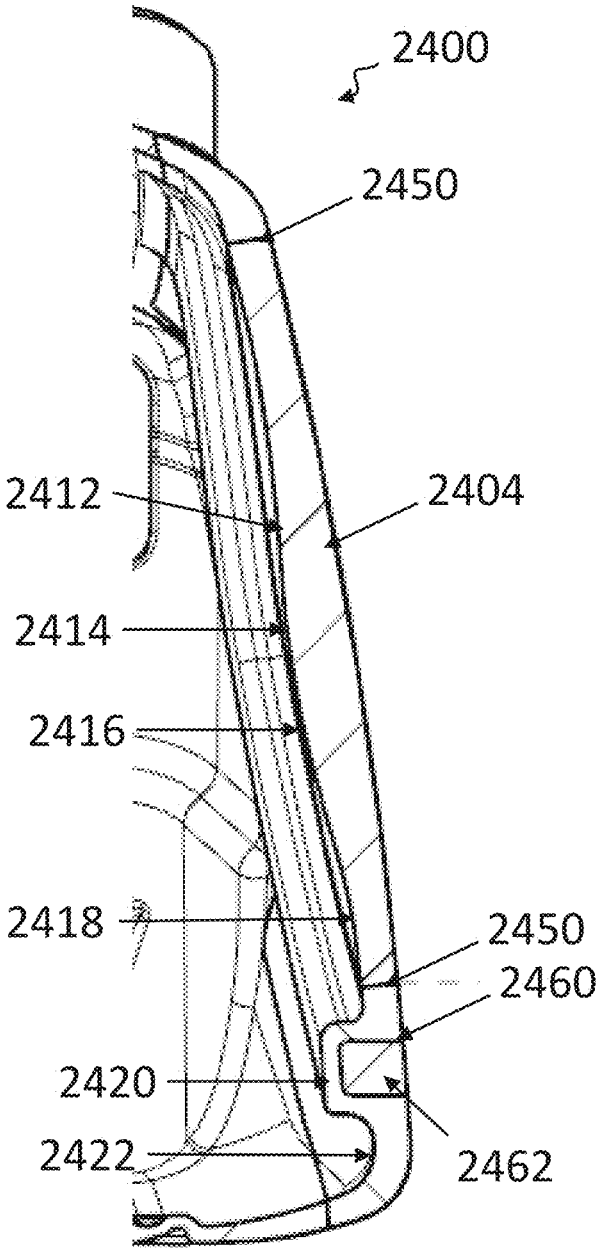
FIG. 25 of the accompanying drawings shows a cross-sectional side view of a golf club head in accordance with an embodiment of the present invention.

FIGS. 24 and 25 illustrate golf club head 2400 in accordance with one or more embodiments of the presently disclosed technology. For example, FIG. 24 of the accompanying drawings shows a perspective view of golf club head 2400 in accordance with an embodiment of the presently disclosed technology. FIG. 25 of the accompanying drawings shows a cross-sectional side view of golf club head 2400 in accordance with an embodiment of the presently disclosed technology. Each of these figures may provide different views of the same or similar components, and may be discussed together herein. Referring first to FIG. 24, in this embodiment, thickened stress reducing region 2420 may include pocket 2460 and weight 2462. The rest of golf club head 2400, which may include, for example, striking face portion 2402, rear body portion 2403, face insert 2404, face perimeter 2406, rear internal surface 2412, thickened central region 2414, central transition region 2416, thinned intermediate region 2418, thinned perimeter region 2422, and/or central opening 2450, may be the same as, or substantially similar to, other golf club heads discussed herein, which may have included, for example, striking face portions, rear body portions, face inserts, face perimeters, rear internal surfaces, thickened central regions, central transition regions, thinned intermediate regions, thinned perimeter regions, and/or central openings.

In this embodiment, thickened stress reducing region 2420 may include pocket 2460 and weight 2462. Thickened stress reducing region 2420 may be otherwise substantially similar to other thickened stress reducing regions discussed herein. Pocket 2460 may be located on a bottom portion of striking face portion 2402 along a shape of thickened stress reducing region 2420. In some embodiments, pocket 2460 may be located elsewhere, including for example, a heel portion of striking face portion 2402 along the shape of thickened stress reducing region 2420, a toe portion of striking face portion 2402 along the shape of thickened stress reducing region 2420, a top portion of striking face portion 2402 along the shape of thickened stress reducing region 2420, and/or other locations without departing from the spirit and scope of the presently disclosed technology. It should be appreciated that that the shape of thickened stress reducing region 2420 may be circular, oval, ring-shaped, horseshoe-shaped, and so on, as discussed herein.

In embodiments, thickened stress reducing region 2420 may include multiple pockets 2460. For example, a first pocket may be located on a heel-bottom portion of striking face portion 2402 along the shape of thickened stress reducing region 2420 (e.g., 6 o'clock to 9 o'clock using the clock grid discussed herein) and a second pocket may be located on a toe-bottom portion of striking face portion 2402 along the shape of thickened stress reducing region 2420 (e.g., 3 o'clock to 6'o clock using the clock grid discussed herein). In some embodiments, pocket 2460 may be about three-quarters of striking face portion 2402 around the shape of thickened stress reducing region 2420. For example, pocket 2460 may span from a toe portion of striking face portion 2402 along the shape of thickened stress reducing region 2420 (e.g., 3 o'clock) to a bottom portion of striking face portion 2402 along the shape of thickened stress reducing region 2420 (e.g., 6 o'clock) to a heel portion of striking face portion 2402 along the shape of thickened stress reducing region 2420 (e.g., 6 o'clock) to a top portion of striking face portion 2402 along the shape of thickened stress reducing region 2420 (e.g., 12 o'clock), though it should be appreciated that pocket 2460 may be otherwise located without departing from the spirit and scope of the presently disclosed technology. In embodiments, pocket 2460 may be about half around a shape of thickened stress reducing region 2420. For example, pocket 2460 may span from a bottom-half portion of striking face portion 2402 along the shape of thickened stress reducing region 2420 (e.g., 3 o'clock to 9 o'clock), though it should be appreciated that pocket 2460 may be otherwise located without departing from the spirit and scope of the presently disclosed technology. In some embodiments, pocket 2460 may be about a quarter around a shape of thickened stress reducing region 2420. For example, pocket 2460 may span a bottom-heel portion of striking face portion 2402 along the shape of thickened stress reducing region 2420 (e.g., 3 o'clock to 6 o'clock), though it should be appreciated that pocket 2460 may be otherwise located without departing from the spirit and scope of the presently disclosed technology. In some embodiments, pocket 2460 may be used in a horseshoe-shaped thickened stress reducing region, though it should be appreciated that pocket 2460 may be used in any thickened stress reducing region, regardless of different shapes. Pocket 2460 may be between about 3.0 mm to about 6.0 mm in height. It should be appreciated that pocket 2460 may be shorter in height and less thick than thickened stress reducing region 2420.

Weight 2462 may fit into pocket 2460. Weight 2462 may fully fill pocket 2460. This may be more clearly illustrated in the cross-sectional view of FIG. 25. In some embodiments, weight 2462 may not fill the full volume of pocket 2460. In some embodiments, weight 2462 may be exposed. That is, weight 2462 may be uncovered. In embodiments, weight 2462 may be covered by an additional component (not shown) of striking face portion 2402. Weight 2462 may be a metal, a plastic, or a composite. The metal may include tungsten, steel, titanium, aluminum, scandium, zinc, nickel, copper, iron, alloys, and/or other metals without departing from the spirit and scope of the presently disclosed technology. The plastic may include thermosets, thermoplastics, and/or other plastics. The composite may include a variety of materials known to those skilled in the art, including for example, graphite, carbon fiber, resins, ceramics, boron fiber, polymers, foams, and/or other composites. In some embodiments, weight 2462 may be a multi-material component. Weight 2462 may be glued, brazed, or welded to pocket 2460. Weight 2462 may be between about 1.0 g/cc to about 30.0 g/cc. In some embodiments, weight 2462 may be about 17.0 g/cc. Weight 2462 may have a greater density than the rest of golf club head 2400. While illustrated as rectangular in the cross-sectional view of FIG. 25, it should be appreciated that weight may be otherwise shaped, sized, and/or dimensioned without departing from the spirit and scope of the presently disclosed technology. From a rear or front view, it may be appreciated that weight 2462 may be curved to match the shape of thickened stress reducing region 2420, which may be circular, substantially oval, horseshoe-shaped, ring-shaped, or otherwise as discussed herein. In some embodiments, weight 2462 may be a unitary piece, that is continuous, or weight 2462 may include multiple pieces. In an installed position, weight 2462 may be flush with an exterior surface of golf club head 2400. Taking into account bulge and roll, in some embodiments, weight 2462 may be near a front-most portion of golf club head 2400.

It should be noted that most of the embodiments discussed here aims to create a releasable hosel hole cover, however, all of these embodiments may include glue to make the hosel hole cover stay within the hosel hole, removing the ability to remove the hosel hoe cover without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, cach numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion, located at a frontal portion of said golf club head, adapted to impact a golf ball; and a body portion, attached to a rear of said striking face portion;

wherein said striking face portion further comprises:

a frontal striking surface, wherein said frontal striking surface is substantially planar; and a rear internal surface;

wherein said frontal striking surface and said rear internal surface combine to further comprise:

a thickened central region, located near a geometric center of said striking face portion, having a first thickness, a central transition region, extending outward radially from said thickened central region, having a variable thickness, a thinned intermediate region, extending outward radially from said central transition region, having a third thickness, a thickened stress reducing region, extending outward radially from said thinned intermediate region, having a fourth thickness, wherein said thickened stress reducing region comprises:

a pocket exposing a faceward portion of said thickened stress reducing region; and a weight to fit into the pocket, and a thinned perimeter region, extending outward radially from said thickened stress reducing region, having a fifth thickness, wherein said fourth thickness is greater than said first thickness.

2. The golf club head of claim 1, wherein said pocket is located near a bottom portion of said striking face portion.

3. The golf club head of claim 1, wherein said pocket is located on a faceward-most portion of said striking face portion.

4. The golf club head of claim 1, wherein said pocket is equal to or less than a half of a perimeter of said thickened stress reducing region.

5. The golf club head of claim 1, wherein said pocket is equal to or less than a quarter of a perimeter of said thickened stress reducing region.

6. The golf club head of claim 1, wherein said weight comprises a metal.

7. The golf club head of claim 6, wherein said metal is tungsten.

8. The golf club head of claim 1, wherein said thickened stress reducing region has a T over H ratio of between about 0.6 to 1.1, said T over H ratio defined as $$T \text{ over } H \text{ Ratio} = \frac{\text{Thickness } T4 \text{ of Thickened Stress Reducing Region}}{\text{Height } H4 \text{ of Thickened Stress Reducing Region}}.$$

9. The golf club head of claim 8, wherein said T over H ratio is between about 0.7 to about 0.9.

10. The golf club head of claim 8, wherein said T over H ratio is about 0.8.

11. A golf club head comprising:

a striking face portion located at a frontal portion of said golf club head, adapted to impact a golf ball; and a body portion, attached to a rear of said striking face portion;

wherein said striking face portion further comprises:

a frontal striking surface, wherein said frontal striking surface is substantially planar; and a rear internal surface;

wherein said frontal striking surface and said rear internal surface combine to further comprise:

a thickened central region, located near a geometric center of said striking face portion, having a first thickness, a central transition region, extending outward radially from said thickened central region, having a variable thickness, a thinned intermediate region, extending outward radially from said central transition region, having a third thickness, a thickened stress reducing region, extending outward radially from said central transition region, having a fourth thickness, wherein said thickened stress reducing region comprises:

a pocket exposing a faceward portion of said thickened stress reducing region; and a thinned perimeter region, extending outward radially from said thickened stress reducing region, having a fifth thickness, wherein said fourth thickness is greater than said first thickness.

12. The golf club head of claim 11, wherein said pocket is located near a bottom portion of said striking face portion.

13. The golf club head of claim 11, wherein said pocket is located on a faceward-most portion of said striking face portion.

14. The golf club head of claim 11, wherein said pocket is equal to or less than a half of a perimeter of said thickened stress reducing region.

15. The golf club head of claim 11, wherein said pocket is equal to or less than a quarter of a perimeter of said thickened stress reducing region.

16. The golf club head of claim 11, wherein the thickened stress reducing region further comprises a weight, and wherein said weight comprises a metal.

17. The golf club head of claim 16, wherein said metal is tungsten.

18. A golf club head comprising:

a striking face portion located at a frontal portion of said golf club head, adapted to impact a golf ball; and a body portion, attached to a rear of said striking face portion, wherein said striking face portion further comprises:

a perimeter region having a central opening, wherein said perimeter region comprises:

a thickened stress reducing region, having a fourth thickness, wherein said thickened stress reducing region comprises:

a pocket exposing a faceward portion of said thickened stress reducing region; and a thinned perimeter region, extending outward radially from said thickened stress reducing region, having a fifth thickness, and a face insert adapted to engage said central opening, wherein said face insert comprises:

a thickened central region, located near a geometric center of said striking face portion, having a first thickness;

a central transition region, extending outward radially from said thickened central region, having a variable thickness, and a thinned intermediate region, extending outward radially from said central transition region, having a third thickness, wherein said fourth thickness is greater than said first thickness.

19. The golf club head of claim 18, wherein said pocket is located on a faceward-most portion of said striking face portion.

20. The golf club head of claim 18, wherein said pocket is equal to or less than a half of a perimeter of said thickened stress reducing region.

* * * * *